US007395879B2

(12) United States Patent
Segura et al.

(10) Patent No.: US 7,395,879 B2
(45) **Date of Patent: *Jul. 8, 2008**

(54) MWD FORMATION TESTER

(75) Inventors: Pedro Segura, Austin, TX (US); Mark A. Sitka, Richmond, TX (US); Gregory N. Gilbert, Sugar Land, TX (US); Preston N. Weintraub, The Woodlands, TX (US); Tony T. Vu, Pearland, TX (US); John R. Hardin, Jr., Spring, TX (US); Kristopher V. Sherrill, Humble, TX (US); David M. Welshans, Damon, TX (US); James E. Stone, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/735,901

(22) Filed: Apr. 16, 2007

(65) Prior Publication Data

US 2007/0181341 A1 Aug. 9, 2007

Related U.S. Application Data

(63) Continuation of application No. 10/440,835, filed on May 19, 2003, now Pat. No. 7,204,309.

(60) Provisional application No. 60/381,243, filed on May 17, 2002.

(51) Int. Cl.
*E21B 49/10* (2006.01)

(52) U.S. Cl. ..... 175/50; 175/59; 166/100; 73/152.22; 73/152.26

(58) Field of Classification Search ..... 175/59, 175/50; 166/100; 73/152.51, 152.26, 152.22, 73/152.47, 152.27

See application file for complete search history.

(56) References Cited

U.S. PATENT DOCUMENTS

| | | | | |
|---|---|---|---|---|
| 3,653,436 | A | 4/1972 | Anderson et al. | |
| 3,934,468 | A * | 1/1976 | Brieger | 73/152.25 |
| 4,416,152 | A | 11/1983 | Wilson | |
| 5,803,186 | A * | 9/1998 | Berger et al. | 175/50 |
| 6,230,557 | B1 | 5/2001 | Ciglenec et al. | |
| 6,301,959 | B1 | 10/2001 | Hrametz et al. | |
| 6,658,930 | B2 | 12/2003 | Abbas | |
| 6,769,296 | B2 * | 8/2004 | Montalvo et al. | 73/152.51 |

* cited by examiner

*Primary Examiner*—Hoang Dang
(74) *Attorney, Agent, or Firm*—Conley Rose, P.C.

(57) ABSTRACT

An apparatus including a drill collar having an outer surface, an assembly for interaction with an earth formation coupled to the drill collar, the assembly including a first member to extend beyond the drill collar outer surface and a second member to extend beyond the first member and toward the earth formation to receive formation fluids. An apparatus including an MWD tool having an outer surface, a formation testing assembly coupled to the MWD tool, the formation testing assembly recessed beneath the outer surface in a first position and including a piston to extend beyond the outer surface to a second position and an inner sampling member to extend beyond the piston to a third position.

20 Claims, 22 Drawing Sheets

| STATE | MOTOR WINDINGS | | | | | | | | |
|---|---|---|---|---|---|---|---|---|---|
| | W1 | AH | AL | W2 | BH | BL | W3 | CH | CL |
| T1 | HI | 1 | 0 | F | 0 | 0 | LO | 0 | 1 |
| T2 | F | 0 | 0 | HI | 1 | 0 | LO | 0 | 1 |
| T3 | LO | 0 | 1 | HI | 1 | 0 | F | 0 | 0 |
| T4 | LO | 0 | 1 | F | 0 | 0 | HI | 1 | 0 |
| T5 | F | 0 | 0 | LO | 0 | 1 | HI | 1 | 0 |
| T6 | HI | 1 | 0 | LO | 0 | 1 | F | 0 | 0 |

| STATE | MOTOR WINDINGS | | | | | | | | |
|---|---|---|---|---|---|---|---|---|---|
| | W1 | AH | AL | W2 | BH | BL | W3 | CH | CL |
| T1 | HI | 1 | 0 | F | 0 | 0 | LO | 0 | 1 |
| T2 | HI | 1 | 0 | LO | 0 | 1 | F | 0 | 0 |
| T3 | F | 0 | 0 | LO | 0 | 1 | HI | 1 | 0 |
| T4 | LO | 0 | 1 | F | 0 | 0 | HI | 1 | 0 |
| T5 | LO | 0 | 1 | HI | 1 | 0 | F | 0 | 0 |
| T6 | F | 0 | 0 | HI | 1 | 0 | LO | 0 | 1 |

MWD FORMATION TESTER

CROSS-REFERENCE TO RELATED APPLICATIONS

The present application is a continuation of U.S. Utility Application Ser. No. 10/440,835, filed May 19, 2003, now U.S. Pat. No. 7,204,309, entitled "MWD Formation Tester," which claims priority to U.S. Provisional Application Ser. No. 60/381,243, filed May 17, 2002, entitled "Formation Tester."

STATEMENT REGARDING FEDERALLY SPONSORED RESEARCH OR DEVELOPMENT

Not applicable.

BACKGROUND OF THE INVENTION

1. Field of the Invention

The preferred embodiments of the present invention are directed to the drilling of oil and gas wells. More particularly, the invention relates to operations that are engaged in while a drill or tool string is downhole. In one aspect, the present invention relates to measuring-while-drilling (MWD) and logging-while-drilling (LWD) systems and other systems and methods for drilling wellbores and simultaneously measuring and recording certain characteristics of the well, particularly when evaluating subsurface zones of interest while these zones are being intersected by the drill string.

2. Background of the Invention

During the drilling and completion of oil and gas wells, it is often necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation pressure, and formation pressure gradient. These tests arc performed in order to determine whether commercial exploitation of the intersected formations is viable.

In the past, wireline formation testers (WFT) and drill stem testing (DST) were most commonly used to perform these tests. DST is one conventional method of formation testing. The basic work stem test tool consists of a packer or packers, valves or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps clean formation fluids at the end of the test. WFT's generally employ the same testing techniques but use a wireline to lower the test tool into the well bore after the drill string has been retrieved from the well bore. The wireline tool typically uses packers also, although the packers are placed closer together, compared to drill pipe conveyed testers, for more efficient formation testing. In some cases, packers are not used. In those instances, the testing tool is brought into contact with the intersected formation and testing is done without zonal isolation. Although WFT's were employed before DST, WFT's continue to be used for their efficiency and cost-effectiveness in certain situations.

As important as these tools are to production and reservoir engineering, their use can be limited by numerous factors.

The amount of time and money required to run these tools downhole can be significant, especially with today's increasingly costly drilling rigs. First, the drill string with the drill bit must be retracted from the wellbore. Then, a separate work string containing the testing equipment, or, if wireline services are used, the wireline tool string, must be lowered into the well to conduct secondary operations. Interrupting the drilling process to perform formation testing can add significant amounts of time to a drilling program, which can be prohibitively expensive with today's drilling rigs. Thus, by interrupting the drilling process, operational costs can become high even though the cost of the DST or WFT itself may be reasonable.

DST and WFT pose additional risks to the borehole, such as tool sticking or formation damage. Specific to WFT are the difficulties of running wireline services in highly deviated and extended reach wells. WFT's also do not have flowbores for the flow of drilling mud, nor are they designed to withstand drilling loads such as torque and weight on bit.

Further, the measurement accuracy of drill stem tests and, especially, of wireline formation tests can be affected by mud invasion and filter cake buildup because significant amounts of time must pass before a DST or WFT may engage the formation. Mud invasion occurs when formation fluids are displaced by drilling mud or mud filtrate. Because the drilling mud ingress begins at the wellbore surface, it is most prevalent there and generally decreases further into the formation. However, the prevalence of the mud invasion at the wellbore surface creates a "skin" or "mudcake," and a "skin effect" may occur because formation testers can only extend relatively short distances into the formation, thereby distorting the representative sample of formation fluids. When invasion occurs, it may become impossible to obtain a representative sample of formation fluids or, at a minimum, the duration of the sampling period must be increased to first remove the drilling fluid and then obtain a representative sample of formation fluids.

Similarly, as drilling fluid with its suspended solids is pumped downhole, the fluid engages the walls or surface of the wellbore and, in a fluid permeable zone, leaves suspended solids on the wellbore surface. If a large amount of solids attach themselves to the well bore surface, a filter cake buildup occurs. The filter cakes act as a region of reduced permeability adjacent to the wellbore. Thus, once filter cakes have formed, the accuracy of reservoir pressure measurements decreases, affecting the calculations for permeability and produceability of the formation.

Consequently, it is of considerable economic importance for tests such as those described hereinabove to be performed as soon as possible after the formation has been intersected by the wellbore, and without interrupting the drilling process. Mud invasion and filter cake buildup increase with time after penetration of the formation, thereby reducing the accuracy of formation test results. Therefore, early evaluation of the potential for profitable recovery of the fluid contained therein is very desirable. For example, such early evaluation enables completion operations to be planned more efficiently. In addition, it has been found that more accurate and useful information can be obtained if testing occurs as soon as possible after penetration of the formation.

in the late 1970's, MWD/LWD technology was born to address the needs of the industry. MWD/LWD technology became mature about a decade later, and eventually incorporated the concept of formation testing. Where early formation evaluation is actually accomplished during drilling operations within the well, the drilling operations may also be more efficiently performed, since results of the early evaluation may then be used to adjust parameters of the drilling operations without interrupting the drilling process. In this respect, it is known in the art to integrate certain formation testing equipment with a drill string so that, as the wellbore is being drilled, and without removing the drill string from the wellbore, formations intersected by the wellbore may be periodically tested.

In typical prior art formation testing equipment suitable for integration with a drill string during drilling operations, various devices or systems are provided for isolating a formation from the remainder of the wellbore, drawing fluid from the formation, and measuring physical properties of the fluid and the formation. Unfortunately, due to the constraints imposed by the necessity of integrating testing equipment with the drill string, problems do exist when using typical prior art formation testing equipment.

For example, formation testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, and scraping of the formation testing equipment against the sides of the wellbore. Sensitive electronics and sensors must be robust enough to withstand the pressures and temperatures, and especially the extreme vibration and shock conditions of the drilling environment, yet maintain accuracy, repeatability, and reliability. Therefore, it is highly desirable for while drilling formation tester systems to be appropriately ruggedized for downhole conditions while maintaining the necessary precision for useful formation measurements. Conventional drilling formation testing tools are not rugged enough for harsh drilling environments, and have not been able to achieve the precision and durability required for efficient formation testing.

In one aspect of formation testing, the formation testing apparatus may include a probe assembly for engaging the borehole wall and acquiring formation fluid samples. The probe assembly may include an isolation pad to engage the borehole wall, or any mudcake accumulated thereon. The isolation pad seals against the mudcake and around a hollow probe, which places an internal cavity in fluid communication with the formation. This creates a fluid pathway that allows formation fluid to flow between the formation and the formation tester while isolated from the wellbore fluid.

In order to acquire a useful sample, the probe must stay isolated from the relative high pressure of the wellbore fluid. Therefore, the integrity of the seal that is formed by the isolation pad is critical to the performance of the tool. If the wellbore fluid is allowed to leak into the collected formation fluids, a non-representative sample will be obtained and the test will have to be repeated.

Examples of isolation pads and probes used in wireline formation testers include Halliburton's DT, SFTT, SFT4, and RDT. Isolation pads that are used with wireline formation testers are generally simple rubber pads affixed to the end of the extending sample probe. The rubber is normally affixed to a metallic plate that provides support to the rubber as well as a connection to the probe. These rubber pads are often molded to fit within the specific diameter hole in which they will be operating.

While conventional rubber pads are reasonably effective in some wireline operations, when a formation tester is used in a MWD or LWD application, they have not performed as desired. Failure of conventional rubber pads has also been a concern in wireline applications that may require the performance of a large number of formation pressure tests during a single run into the wellbore, especially in wells having particularly harsh operating conditions. In a MWD or LWD environment, the formation tester is integrated into the drill string and is thus subjected to the harsh downhole environment for a much longer period than in a wireline testing application. In addition, during drilling, the formation tester is constantly rotated with the drill string and may contact the side of the wellbore and damage any exposed isolator pads. The pads may also be damaged during drilling by the drill cuttings that are being circulated through the wellbore by the drilling fluid.

Therefore, in addition to ruggedizing the overall apparatus for use as a while drilling, MWD-based formation tester, there remains a need in the art to develop an isolation pad that provides reliable sealing performance with an increased durability and resistance to damage. Furthermore, in addition to these characteristics, the industry would welcome a field replaceable pad for use in the while drilling formation tester.

BRIEF SUMMARY OF SOME OF THE PREFERRED EMBODIMENTS OF THE INVENTION

The problems noted above are solved in large part by a novel formation testing tool which is described herein. In one embodiment, an apparatus includes a drill collar having an outer surface, an assembly for interaction with an earth formation coupled to the drill collar, the assembly including a first member to extend beyond the drill collar outer surface and a second member to extend beyond the first member and toward the earth formation to receive formation fluids.

In another embodiment, an apparatus includes an MWD tool having an outer surface, a formation testing assembly coupled to the MWD tool, the formation testing assembly recessed beneath the outer surface in a first position and including a piston to extend beyond the outer surface to a second position, and an inner sampling member to extend beyond the piston to a third position.

In another embodiment, a system for drilling a borehole and testing an earth formation includes a drill string having a drill bit and a bottom hole assembly, an MWD tool coupled to the bottom hole assembly, a formation testing assembly coupled to the MWD tool including a first member having a seal pad with an outer surface, the first member to extend the seal pad into engagement with an earth formation, and a second member to extend from the first member and beyond the seal pad outer surface to receive formation fluids.

in another embodiment, a method of engaging an earth formation for testing includes disposing a formation testing assembly on a drill string, the formation testing assembly having a first extendable member and a second extendable member, drilling a bore hole in an earth formation, extending the first extendable member beyond an outer surface of the drill string, extending the second extendable member beyond the first extendable member, and receiving fluids from the earth formation.

In other embodiments, the formation testing tool includes a formation probe assembly having an extendable sampling probe surrounded by a cylindrical sleeve. The sleeve is configured to engage a metal skirt having an elastomeric seal pad coupled thereto. The elastomeric pad has a non-planar outer surface which engages a borehole wall in preparation for formation testing. The seal pad may be donut-shaped, having an aperture through the middle of the seal pad. The seal pad and its surface may include numerous different embodiments, including having a curved profile. The seal pad may also include numerous different embodiments of means for coupling the seal pad to the metal skirt.

The formation testing tool also may include formation probe assembly anti-rotation means, a deviated non-circular flowbore, and at least one closed hydraulic fluid chamber for balancing fluid pressures.

The disclosed devices and methods comprise a combination of features and advantages which enable it to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of preferred embodiments of the present invention, reference will now be made to the accompanying drawings, wherein.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples" and "coupled" used to describe electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the wellbore and "down" meaning towards the bottom of the wellbore. In addition, in the discussion and claims that follow, it is sometimes stated that certain components or elements are in fluid communication. By this it is meant that the components are constructed and interrelated such that a fluid could be communicated between them, as via a passageway, tube or conduit.

Also, as used herein, the designation "MWD" is used to mean all generic measurement while drilling and logging while drilling apparatus and systems.

DETAILED DESCRIPTION OF PREFERRED EMBODIMENTS

Figure 1:
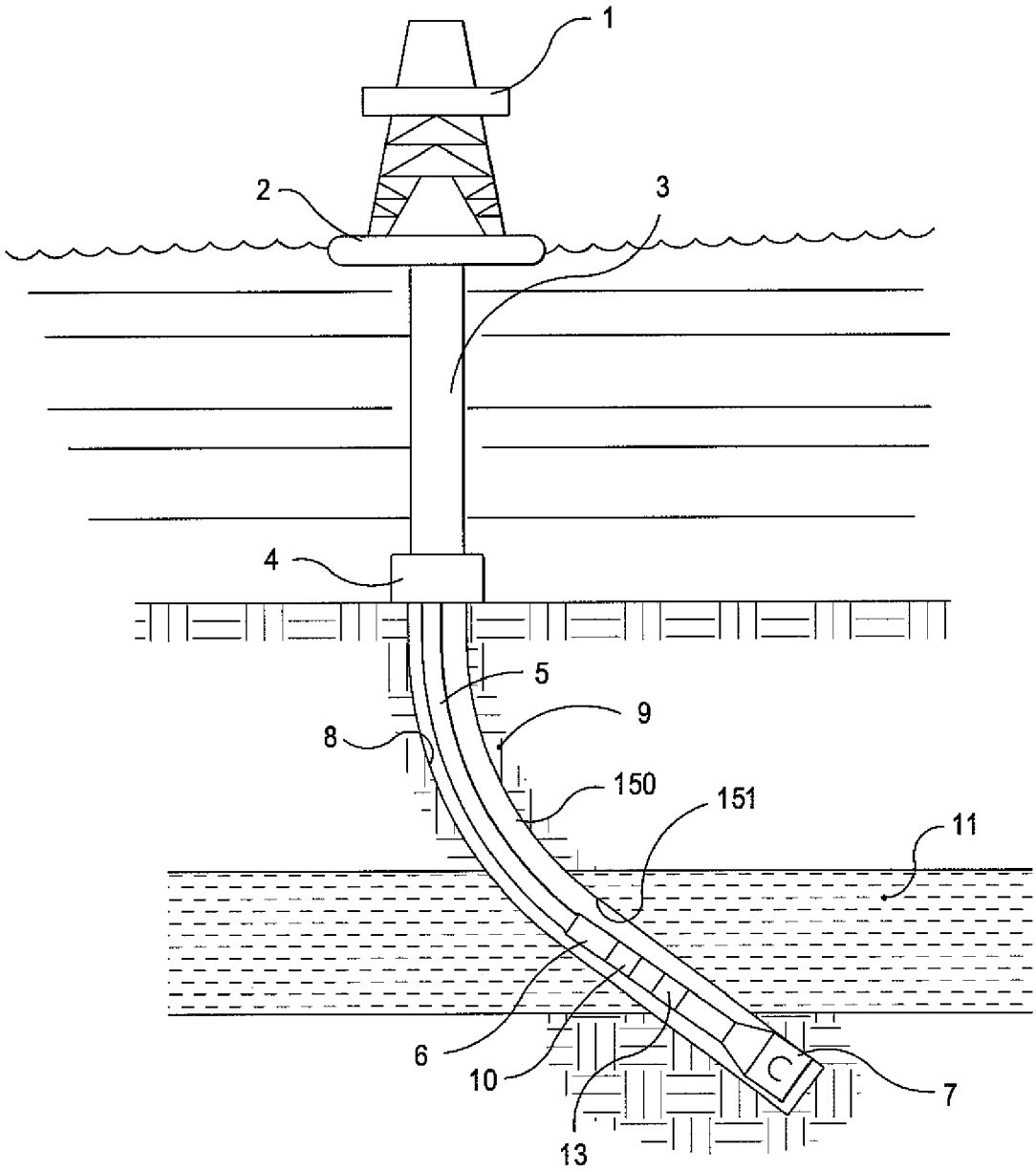
FIG. 1 is a schematic elevation view, partly in cross-section, of a preferred embodiment of the formation tester apparatus disposed in a subterranean well.

Referring to FIG. 1, a formation tester tool 10 is shown as a part of bottom hole assembly 6 which includes an MWD sub 13 and a drill bit 7 at its lower most end. Bottom hole assembly 6 is lowered from a drilling platform 2, such as a ship or other conventional platform, via drill string 5. Drill string 5 is disposed through riser 3 and well head 4. Conventional drilling equipment (not shown) is supported within derrick 1 and rotates drill string 5 and drill bit 7, causing bit 7 to form a borehole 8 through the formation material 9. The borehole 8 penetrates subterranean zones or reservoirs, such as reservoir 11, that are believed to contain hydrocarbons in a commercially viable quantity. It should be understood that formation tester 10 may be employed in other bottom hole assemblies and with other drilling apparatus in land-based drilling, as well as offshore drilling as shown in FIG. 1. In all instances, in addition to formation tester 10, the bottom hole assembly 6 contains various conventional apparatus and systems, such as a down hole drill motor, mud pulse telemetry system, measurement-while-drilling sensors and systems, and others well known in the art.

The primary components and general configuration of formation tester tool 10 are best understood with reference to FIGS. 2A-2E. Formation tester 10 generally comprises a heavy walled housing 12 made of multiple sections of drill collar 12*a*, 12*b*, 12*c*, and 12*d* which threadedly engage one another so as to form the complete housing 12. Bottom hole assembly 6 includes flow bore 14 formed through its entire length to allow passage of drilling fluids from the surface through the drill string 5 and through the bit 7. The drilling fluid passes through nozzles in the drill bit face and flows upwards through borehole 8 along the annulus 150 formed between housing 12 and borehole wall 151.

Figure 2A:
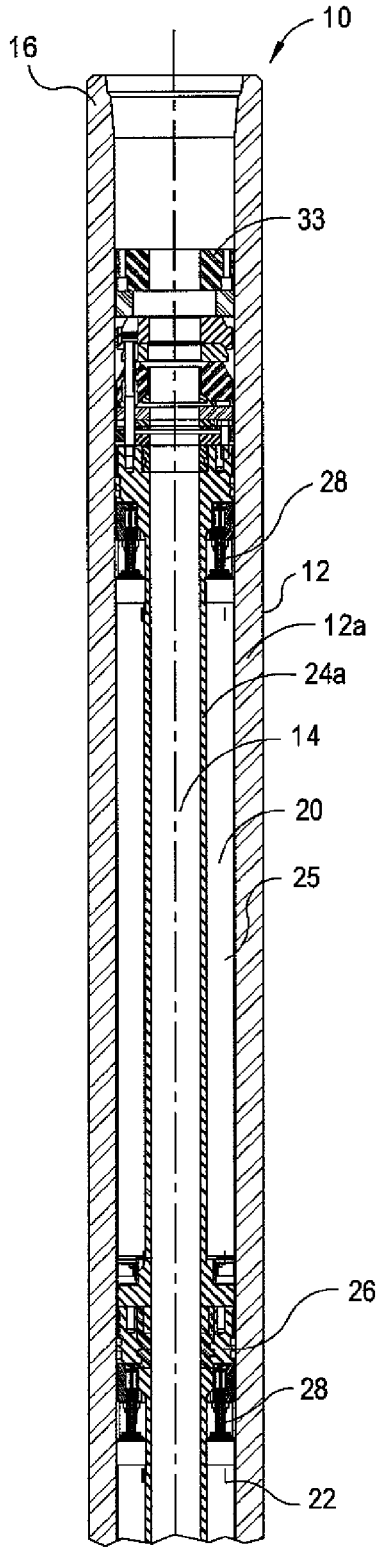
FIGS. 2A-2E are schematic elevation views, partly in cross-section, of portions of the bottomhole assembly and formation tester assembly shown in FIG. 1.
Figure 2B:
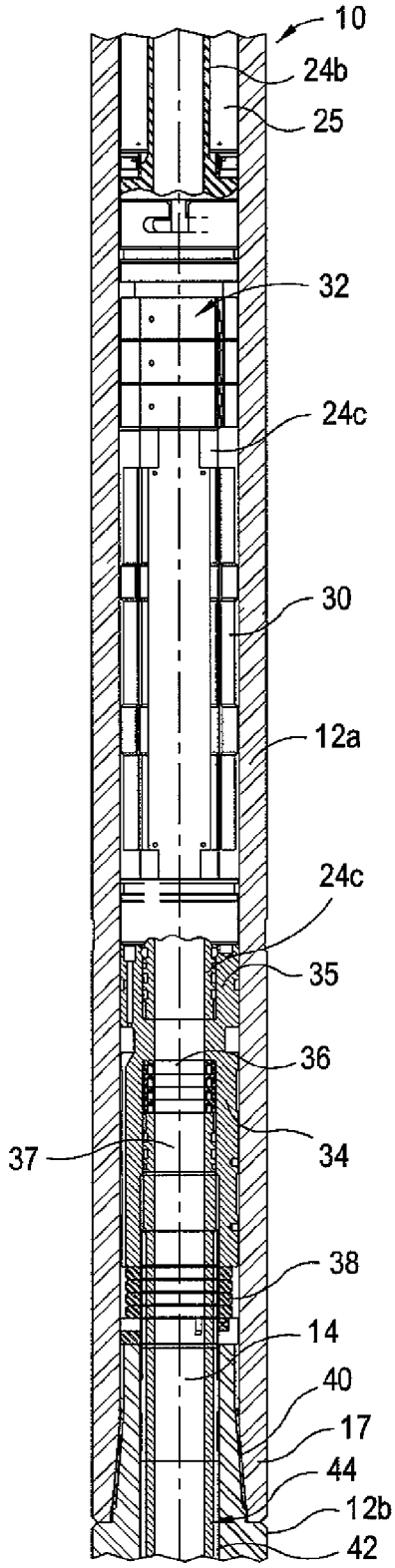

Referring to FIGS. 2A and 2B, upper section 12*a* of housing 12 includes upper end 16 and lower end 17. Upper end 16 includes a threaded box for connecting formation tester 10 to drill string 5. Lower end 17 includes a threaded box for receiving a correspondingly threaded pin end of housing section 12*b*. Disposed between ends 16 and 17 in housing section 12*a* are three aligned and connected sleeves or tubular inserts 24*a,b,c* which creates an annulus 25 between sleeves 24*a,b,c* and the inner surface of housing section 12*a*. Annulus 25 is sealed from flowbore 14 and provided for housing a plurality of electrical components, including battery packs 20, 22. Battery packs 20, 22 are mechanically interconnected at connector 26. Electrical connectors 28 are provided to interconnect battery packs 20, 22 to a common power bus (not shown). Beneath battery packs 20, 22 and also disposed about sleeve insert 24*c* in annulus 25 is electronics module 30. Electronics module 30 includes the various circuit boards, capacitors banks and other electrical components, including the capacitors shown at 32. A connector 33 is provided adjacent upper end 16 in housing section 12*a* to electrically couple the electrical components in formation tester tool 10 with other components of bottom hole assembly 6 that are above housing 12.

Beneath electronics module 30 in housing section 12*a* is an adapter insert 34. Adapter 34 connects to sleeve insert 24*c* at connection 35 and retains a plurality of spacer rings 36 in a central bore 37 that forms a portion of flowbore 14. Lower end 17 of housing section 12*a* connects to housing section 12*b* at threaded connection 40. Spacers 38 are disposed between the lower end of adapter 34 and the pin end of housing section 12*b*. Because threaded connections such as connection 40, at various times, need to be cut and repaired, the length of sections 12*a*, 12*b* may vary in length. Employing spacers 36, 38 allow for adjustments to be made in the length of threaded connection 40.

Housing section 12*b* includes an inner sleeve 44 disposed therethrough. Sleeve 44 extends into housing section 12*a* above, and into housing section 12*c* below. The upper end of sleeve 44 abuts spacers 36 disposed in adapter 34 in housing section 12*a*. An annular area 42 is formed between sleeve 44 and the wall of housing 12*b* and forms a wire way for electrical conductors that extend above and below housing section 12*b*, including conductors controlling the operation of formation tester 10 as described below.

Figure 2C:
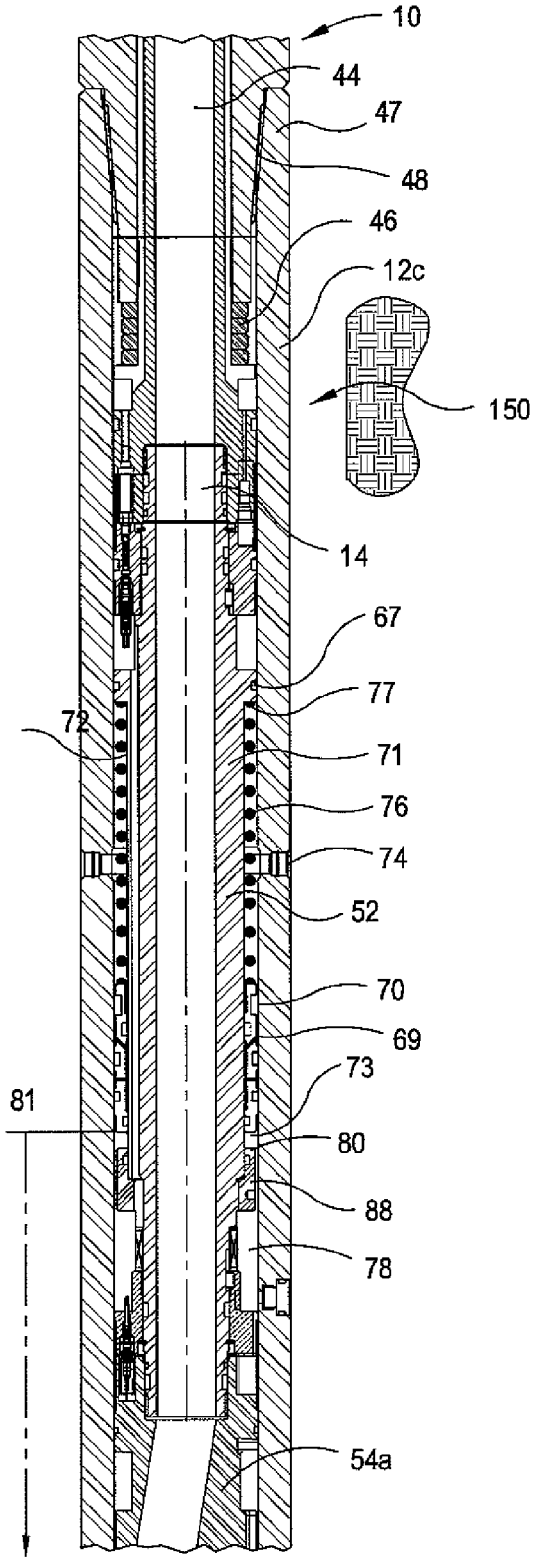
Figure 5:
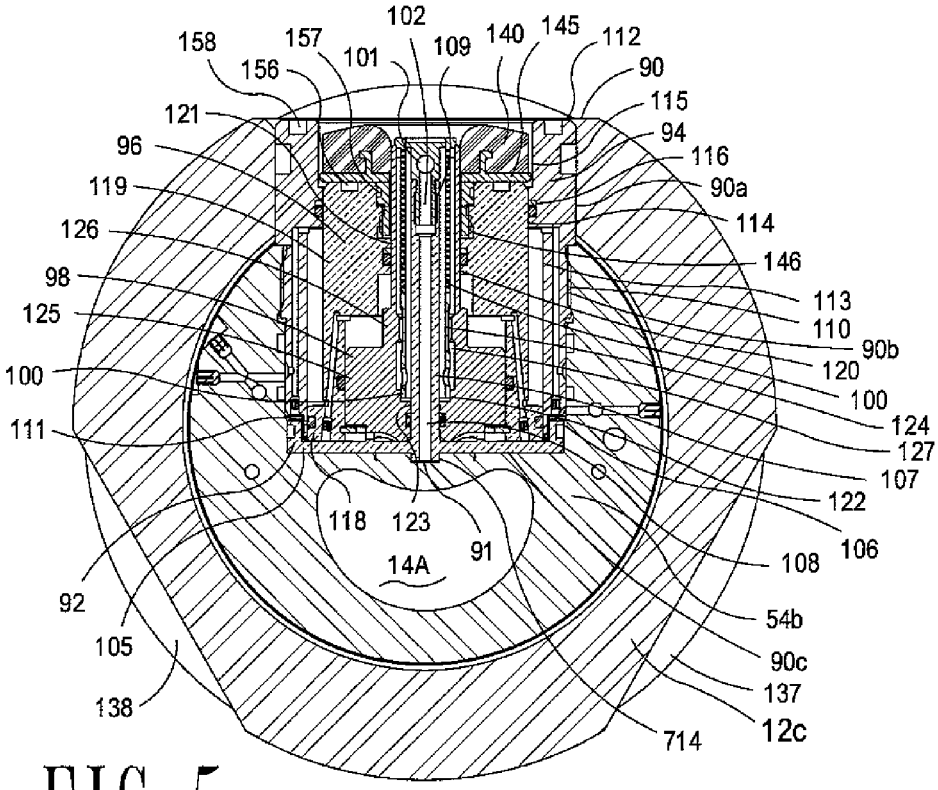
FIG. 5 is a cross-sectional view of the formation probe assembly taken along line 5-5 shown in FIG. 4.

Referring now to FIGS. 2B and 2C, housing section 12*c* includes upper box end 47 and lower box end 48 which threadingly engage housing section 12*b* and housing section 12*c*, respectively. For the reasons previously explained, adjusting spacers 46 are provided in housing section 12*c* adjacent to end 47. As previously described, insert sleeve 44 extends into housing section 12*c* where it stabs into insert mandrel 52. The lower end of inner mandrel 52 stabs into the upper end of formation tester mandrel 54, which is comprised of three axially aligned and connected sections 54*a,b,c*. Extending through mandrel 54 is a deviated flowbore portion 14*a*. Deviating flowbore 14 into flowbore path 14*a* provides sufficient space within housing section 12*c* for the formation tool components described in more detail below. As best shown in FIG. 2E, deviated flowbore 14*a* eventually centralizes near the lower end 48 of housing section 12*c*, shown generally at location 56. Referring momentarily to FIG. 5, the cross-sectional profile of deviated flowbore 14*a* is non-circular in segment 14*b*, so as to provide as much room as possible for the formation probe assembly 50.

Figure 2D:
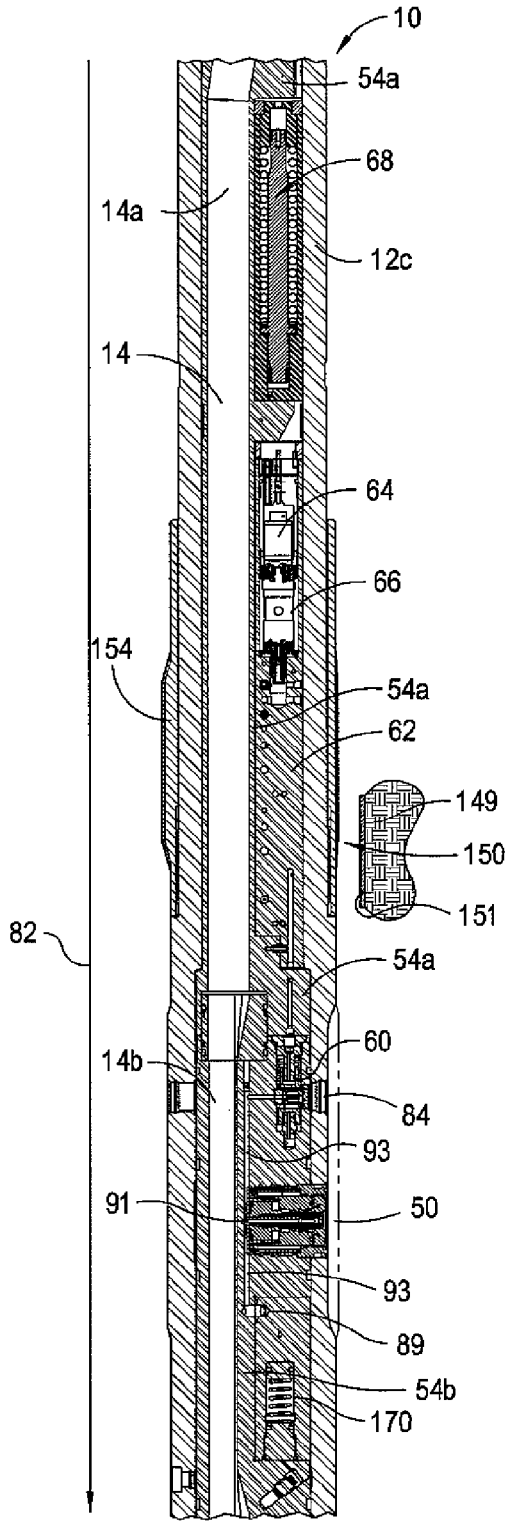
Figure 2E:
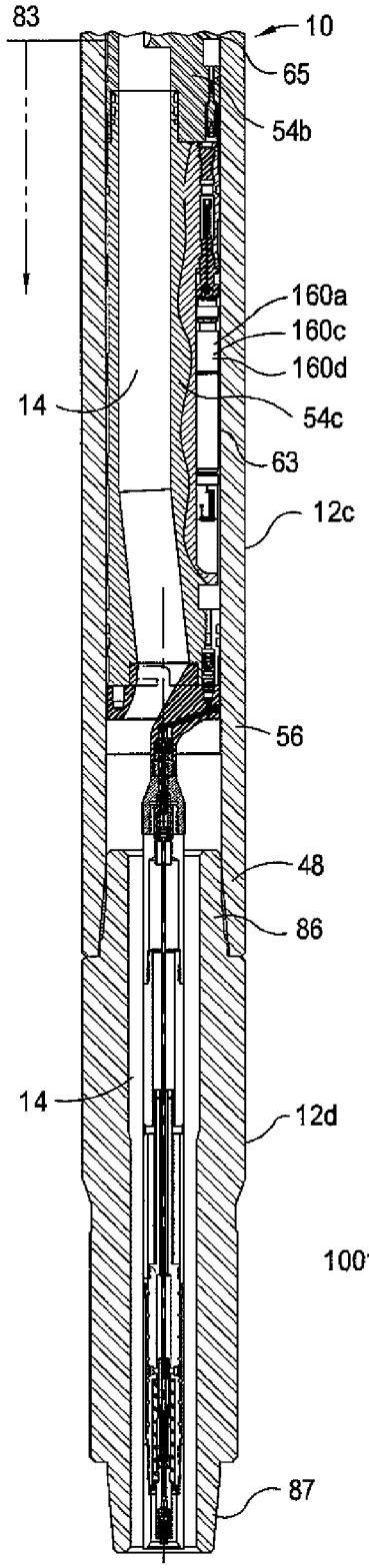

As best shown in FIGS. 2D, E, disposed about formation tester mandrel 54 and within housing section 12*c* are electric motor 64, hydraulic pump 66, hydraulic manifold 62, equalizer valve 60, formation probe assembly 50, pressure transducers 160, and draw down piston 170. Hydraulic accumulators provided as part of the hydraulic system for operating formation probe assembly 50 are also disposed about mandrel 54 in various locations, one such accumulator 68 being shown in FIG. 2D.

Electric motor 64 is preferably a permanent magnet motor and is powered by battery packs 20, 22 and capacitor banks 32. Motor 64 is interconnected to and drives hydraulic pump 66. Pump 66 provides fluid pressure for actuating formation probe assembly 50. Hydraulic manifold 62 includes various solenoid valves, check valves, filters, pressure relief valves, thermal relief valves, pressure transducer 160*b* and hydraulic circuitry employed in actuating and controlling formation probe assembly 50 as explained in more detail below.

Referring again to FIG. 2C, mandrel 52 includes a central segment 71. Disposed about segment 71 of mandrel 52 are pressure balance piston 70 and spring 76. Mandrel 52 includes a spring stop extension 77 at the upper end of segment 71. Stop ring 88 is threaded to mandrel 52 and includes a piston stop shoulder 80 for engaging corresponding annular shoulder 73 formed on pressure balance piston 70. Pressure balance piston 70 further includes a sliding annular seal or barrier 69. Barrier 69 consists of a plurality of inner and outer o-ring and lip seals axially disposed along the length of piston 70.

Beneath piston 70 and extending below inner mandrel 52 is a lower oil chamber or reservoir 78, described more fully below. An upper chamber 72 is formed in the annulus between central portion 71 of mandrel 52 and the wall of housing section 12*c*, and between spring stop portion 77 and pressure balance piston 70. Spring 76 is retained within chamber 72. Chamber 72 is open through port 74 to annulus 150. As such, drilling fluids will fill chamber 72 in operation. An annular seal 67 is disposed about spring stop portion 77 to prevent drilling fluid from migrating above chamber 72.

Barrier 69 maintains a seal between the drilling fluid in chamber 72 and the hydraulic oil that fills and is contained in oil reservoir 78 beneath piston 70. Lower chamber 78 extends from barrier 69 to seal 65 located at a point generally noted as 83 and just above transducers 160 in FIG. 2E. The oil in reservoir 78 completely fills all space between housing section 12*c* and formation tester mandrel 54. It is preferred that the hydraulic oil in chamber 78 be maintained at slightly greater pressure than the hydrostatic pressure of the drilling fluid in annulus 150. The annulus pressure is applied to piston 70 via drilling fluid entering chamber 72 through port 74. Because lower oil chamber 78 is a closed system, the annulus pressure that is applied via piston 70 is applied to the entire chamber 78. Additionally, spring 76 provides a slightly greater pressure to the closed oil system 78 such that the pressure in oil chamber 78 is substantially equal to the annulus fluid pressure plus the pressure added by the spring force. This slightly greater oil pressure is desirable so as to maintain positive pressure on all the seals in oil chamber 78. Having these two pressures generally balanced (even though the oil pressure is slightly higher) is easier to maintain than if there was a large pressure differential between the hydraulic oil and the drilling fluid. Between barrier 69 in piston 70 and point 83, the hydraulic oil fills all the space between the outside diameter of mandrels 52, 54 and the inside diameter of housing section 12*c*, this region being marked as distance 82 between points 81 and 83. The oil in reservoir 78 is employed in the hydraulic circuit 200 (FIG. 10) used to operate and control formation probe assembly 50 as described in more detailed below.

Figure 3:
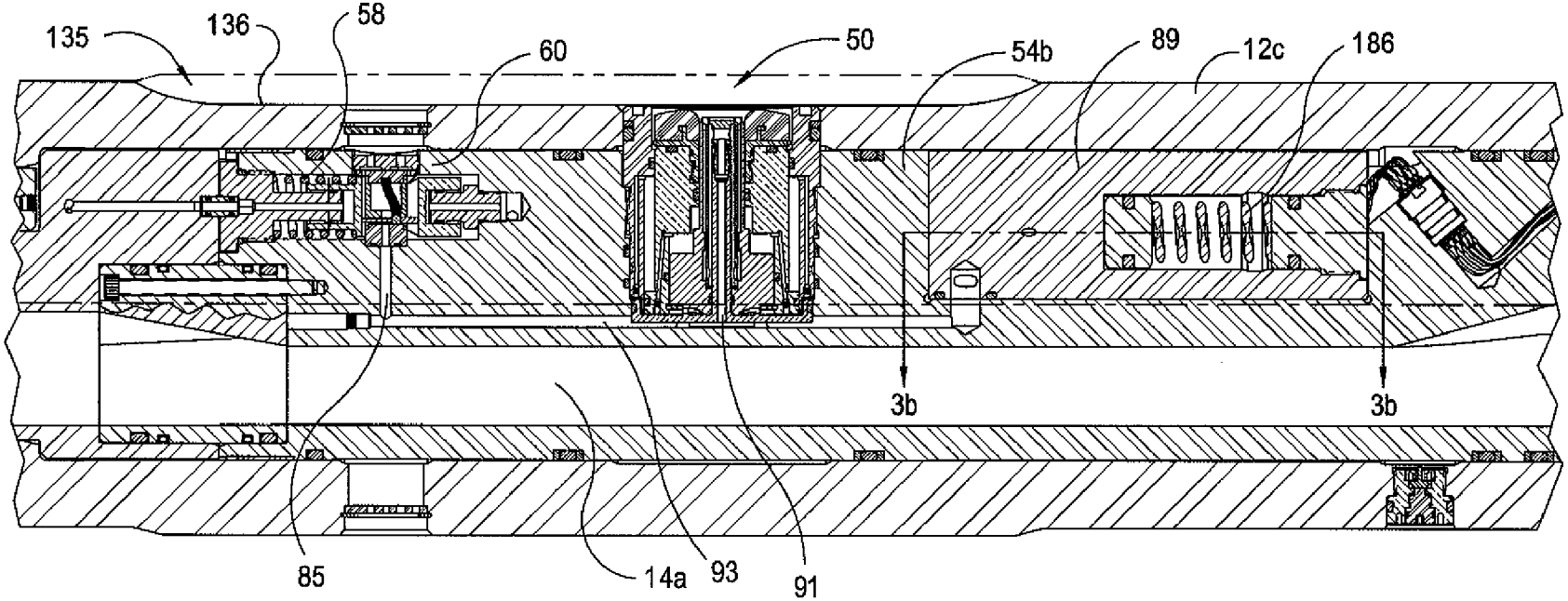
FIG. 3 is an enlarged elevation view, partly in cross-section, of the formation tester tool portion of the formation tester assembly shown in FIG. 2D.

Equalizer valve 60, best shown in FIG. 3, is disposed in formation tester mandrel 54*b* between hydraulic manifold 62 and formation probe assembly 50. Equalizer valve 60 is in fluid communication with hydraulic passageway 85 and with longitudinal fluid passageway 93 formed in mandrel 54*b*. Prior to actuating formation probe assembly 50 so as to test the formation, drilling fluid fills passageways 85 and 93 as valve 60 is normally open and communicates with annulus 150 through port 84 in the wall of housing section 12*c*. When the formation fluids are being sampled by formation probe assembly 50, valve 60 closes the passageway 85 to prevent drilling fluids from annulus 150 entering passageway 85 or passageway 93. A valve particularly well suited for use in this application is the valve described in provisional Patent Application No. 60/381,419, filed May 17, 2002, entitled Equalizer Valve, and in the patent application filed concurrently herewith via Express Mail No. EV 324573704 US and entitled Equalizer Valve, which claims priority to the previously referenced provisional application, both applications hereby incorporated by reference herein for all purposes.

Although valves of various types can be employed in the formation tester 10, and while these valves can be positioned in differing locations within housing 12, it is preferred that equalizer valve 60 be positioned above probe assembly 50 and above pressure transducers 160*a,c,d*. With this arrangement, during formation testing, gas bubbles from the formation fluid being sampled are permitted to rise above formation probe assembly 50 toward equalizer valve 60 and away from pressure transducers 160*a, c, d*. Eliminating gas in the fluid adjacent to these pressure transducers produces a better and more accurate value of the sensed formation pressure.

Figure 4:
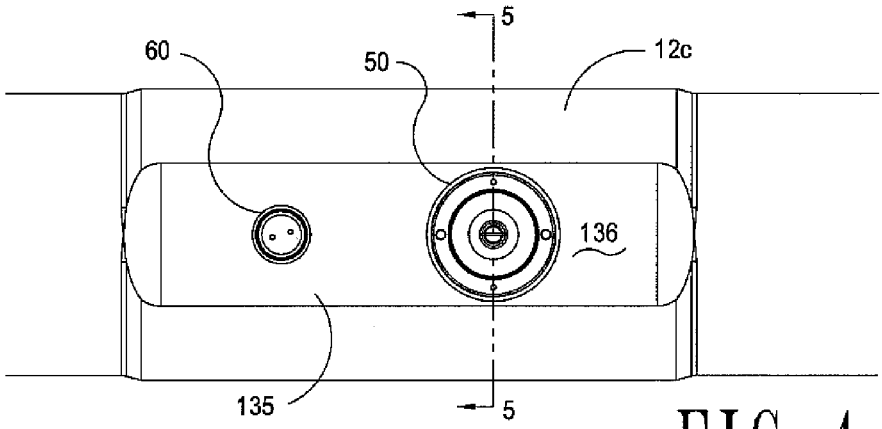
FIG. 4 is an elevation view of the formation tester tool shown in FIG. 3.

As shown in FIGS. 3 and 4, housing section 12*c* includes a recessed portion 135 adjacent to formation probe assembly 50 and equalizer valve 60. The recessed portion 135 includes a planar surface or "flaf" 136. The ports through which fluids may pass into equalizing valve 60 and probe assembly 50 extend through flat 136. In this manner, as drill string 5 and formation tester 10 are rotated in the borehole, formation probe assembly 50 and equalizer valve 60 are better protected from impact, abrasion and other forces. Flat 136 is recessed at least ¼ inch and more preferably at least ½ inch from the outer diameter of housing section 12*c*. Similar flats 137, 138 are also formed about housing section 12*c* at generally the same axial position as flat 136 to increase flow area for drilling fluid in the annulus 150 of borehole 8.

Disposed about housing section 12*c* adjacent to formation probe assembly 50 is stabilizer 154. Stabilizer 154 preferably has an outer diameter close to that of nominal bore hole size. As explained below, formation probe assembly 50 includes a seal pad 140 that is extendable to a position outside of housing 12*c* to engage the bore hole wall 151. As explained, probe assembly 50 and seal pad 140 of formation probe assembly 50 are recessed from the outer diameter of housing section 12*c*, but they are otherwise exposed to the environment of annulus 150 where they could be impacted by the bore hole wall 151 during drilling or during insertion or retrieval of bottom hole assembly 6. Accordingly, being positioned adjacent to formation probe assembly 50, stabilizer 154 provides additional protection to the seal pad 140 during insertion, retrieval and operation of bottom hole assembly 6. It also provides protection to pad 140 during operation of formation tester 10. In operation, seal pad 140 is extended by a piston to a position where it engages the borehole wall 151. The force of the pad 140 against the borehole wall 151 would tend to move the formation tester 10 in the borehole, and such movement could cause pad 140 to become damaged. However, as formation tester 10 moves sideways within the bore hole as the piston is extended into engagement with the bore hole wall 151, stabilizer 154 engages the bore hole wall and provides a reactive force to counter the force applied to the piston by the formation. In this manner, further movement of the formation test tool 10 is resisted.

Referring to FIG. 2E, mandrel 54*c* contains chamber 63 for housing pressure transducers 160*a,c,d* as well as electronics for driving and reading these pressure transducers. In addition, the electronics in chamber 63 contain memory, a microprocessor, and power conversion circuitry for properly utilizing power from power bus 700. Generally, reference can be made to FIGS. 17-22 for various views of the pressure electronics insert assembly of the formation tester.

Referring still to FIG. 2E, housing section 12*d* includes pins ends 86, 87. Lower end 48 of housing section 12*c* threadedly engages upper end 86 of housing section 12*d*. Beneath housing section 12*d*, and between formation tester tool 10 and drill bit 7 are other sections of the bottom hole assembly 6 that constitute conventional MWD tools, generally shown in FIG. 1 as MWD sub 13. In a general sense, housing section 12*d* is an adapter used to transition from the lower end of formation tester tool 10 to the remainder of the bottom hole assembly 6. The lower end 87 of housing section 12*d* threadedly engages other sub assemblies included in bottom hole assembly 6 beneath formation tester tool 10. As shown, flowbore 14 extends through housing section 12*d* to such lower subassemblies and ultimately to drill bit 7.

Figure 3A:
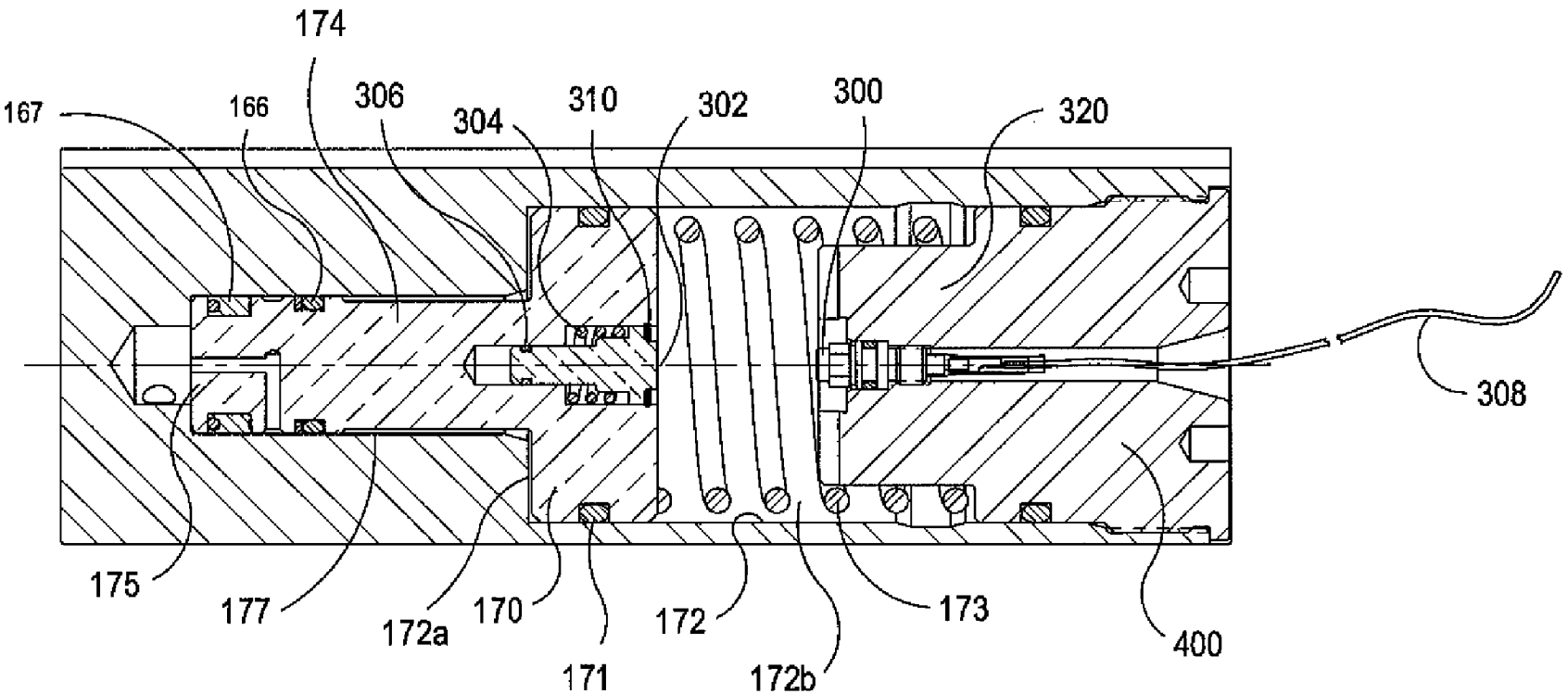
FIG. 3A is an enlarged cross-section view of the draw down piston and chamber shown in FIG. 3.
Figure 3B:
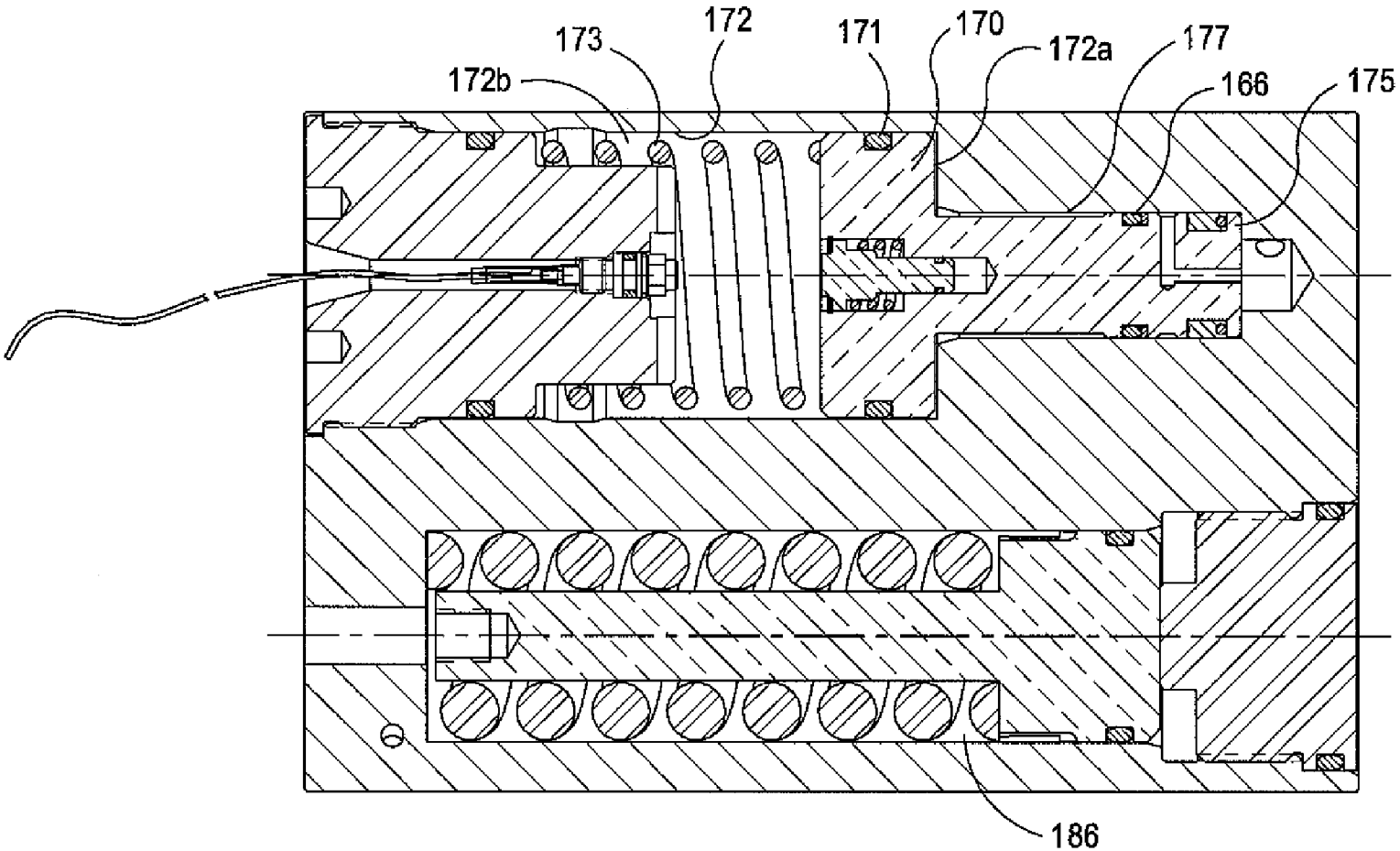
FIG. 3B is an enlarged cross-section view along line 3B-3B of FIG. 3.

Referring again to FIG. 3 and to FIG. 3A, drawdown piston 170 is retained in drawdown manifold 89 which is mounted on formation tester mandrel 54*b* within housing 12*c*. Piston 170 includes annular seal 171 and is slidingly received in cylinder 172. Spring 173 biases piston 170 to its uppermost or shouldered position as shown in FIG. 3A. Separate hydraulic lines (not shown) interconnect with cylinder 172 above and below piston 170 in portions 172*a*, 172*b* to move piston 170 either up or down within cylinder 172 as described more fully below. A plunger 174 is integral with and extends from piston 170. Plunger 174 is slidingly disposed in cylinder 177 coaxial with 172. Cylinder 175 is the upper portion of cylinder 177 that is in fluid communication with the longitudinal passageway 93 as shown in FIG. 3A. Cylinder 175 is flooded with drilling fluid via its interconnection with passageway 93. Cylinder 177 is filled with hydraulic fluid beneath seal 166 via its interconnection with hydraulic circuit 200. Plunger 174 also contains scraper 167 which protects seal 166 from debris in the drilling fluid. Scraper 167 is preferable an o-ring energized lip seal.

As best shown in FIG. 5, formation probe assembly 50 generally includes stem 92, a generally cylindrical adapter sleeve 94, piston 96 adapted to reciprocate within adapter sleeve 94, and a snorkel assembly 98 adapted for reciprocal movement within piston 96. Housing section 12*c* and formation tester mandrel 54*b* include aligned apertures 90*a*, 90*b*, respectively, that together form aperture 90 for receiving formation probe assembly 50.

Stem 92 includes a circular base portion 105 with an outer flange 106. Extending from base 105 is a tubular extension 107 having central passageway 108. The end of extension 107 includes internal threads at 109. Central passageway 108 is in fluid connection with fluid passageway 91 that, in turn, is in fluid communication with longitudinal fluid chamber or passageway 93, best shown in FIG. 3.

Adapter sleeve 94 includes inner end 111, that engages flange 106 of stem number 92. Adapter sleeve 94 is secured within aperture 90 by threaded engagement with mandrel 54*b* at segment 110. The outer end 112 of adapter sleeve 94 extends to be substantially flushed with flat 136 formed in housing member 12*c*. Circumferentially spaced about the outermost surface of adapter sleeve 94 is a plurality of tool engaging recesses 158. These recesses are employed to thread adapter 94 into and out of engagement with mandrel 54*b*. Adapter sleeve 94 includes cylindrical inner surface 113 having reduced diameter portions 114, 115. A seal 116 is disposed in surface 114. Piston 96 is slidingly retained within adapter sleeve 94 and generally includes base section 118 and an extending portion 119 that includes inner cylindrical surface 120. Piston 96 further includes central bore 121.

Snorkel 98 includes a base portion 125, a snorkel extension 126, and a central passageway 127 extending through base 125 and extension 126.

Formation tester apparatus 50 is assembled such that piston base 118 is permitted to reciprocate along surface 113 of adapter sleeve 94. Similarly, snorkel base 125 is disposed within piston 96 and snorkel extension 126 is adapted for reciprocal movement along piston surface 120. Central passageway 127 of snorkel 98 is axially aligned with tubular extension 107 of stem 92 and with screen 100.

Figure 6C:
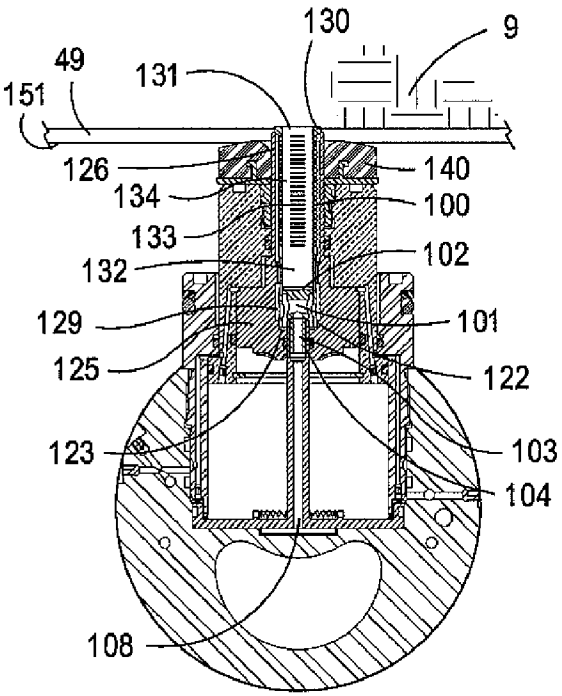
FIGS. 6A-6C are cross-sectional views of a portion of the formation probe assembly taken along the same line as seen in FIG. 5, the probe assembly being shown in a different position in each of FIGS. 6A-6C.

Referring to FIGS. 5 and 6C, screen 100 is a generally tubular member having a central bore 132 extending between a fluid inlet end 131 and outlet end 122. Outlet end 122 includes a central aperture 123 that is disposed about stem extension 107. Screen 100 further includes a flange 130 adjacent to fluid inlet end 131 and an internally slotted segment 133 having slots 134. Apertures 129 are formed in screen 100 adjacent end 122. Between slotted segment 133 and apertures 129, screen 100 includes threaded segment 124 for threadedly engaging snorkel extension 126.

Scraper 102 includes a central bore 103, threaded extension 104 and apertures 101 that are in fluid communication with central bore 103. Section 104 threadedly engages internally threaded section 109 of stem extension 107, and is disposed within central bore 132 of screen 100.

Referring now to FIG. 5, 7-9, seal pad 140 is generally donut-shaped having base surface 141, an opposite sealing surface 142 for sealing against the borehole wall, a circumferential edge surface 143 and a central aperture 144. In the embodiment shown, base surface 141 is generally flat and is bonded to a metal skirt 145. Seal pad 140 seals and prevents drilling fluid from entering the probe assembly 50 during formation testing so as to enable pressure transducers 160 to measure the pressure of the formation fluid. Formation fluid pressure provides an indication of the permeability of the formation 9. More specifically, seal pad 140 seals against the filter cake 149 that forms on the borehole wall. Typically, the pressure of the formation fluid is less than the pressure of the drilling fluids that are injected into the borehole. A layer of residue from the drilling fluid forms a filter cake 149 on the borehole wall and separates the two pressure areas. Pad 140, when extended, conforms its shape to the borehole wall and, together with the filter cake 149, forms a seal through which formation fluids can be collected.

Seal pad 140 is designed to be easily replaced in the field. To enhance the ability to replace seal pad 140 in the field, skirt 145 is formed with tool recesses 152 spaced about its perimeter. Preferably, ring 145 extends slightly beyond edge surface 143 of seal pad 140 by about 0.03 inches or more, and the recesses are formed in the extending portion 153. A tool having fingers spaced to match the position of recesses 152 can then be disposed over pad 140 so that the fingers engage the recesses. Rotation of the tool thus rotates skirt 145 and unthreads it from engagement with piston 96. A new seal pad 140, bonded to a skirt 145 can then be installed. As best shown in FIGS. 3, 5 and 6, pad 140 is sized so that it can be retracted completely within aperture 90. In this position, pad 140 is protected both by flat 136 that surrounds aperture 90 and by recess 135 which positions face 136 in a setback position with respect to the outside surface of housing 12.

Figure 6B:
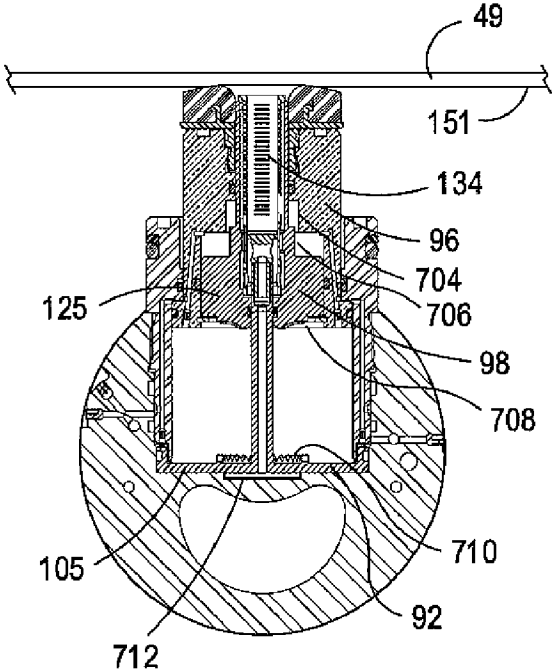
Figure 6A:
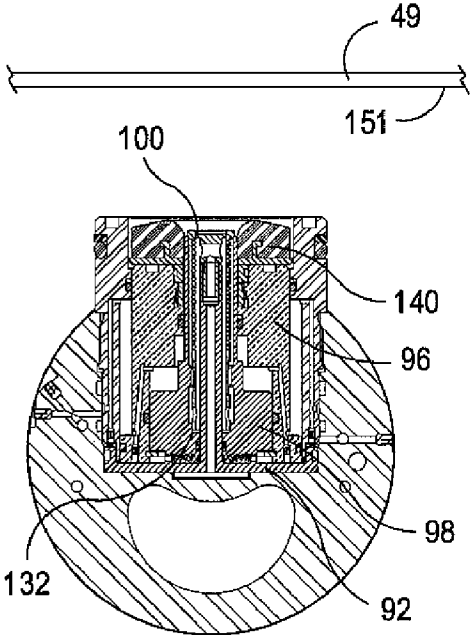

During the assembly or disassembly of the pad/skirt combination, the torque applied by the installation/removal tool must be reacted into mandrel 54*b* to prevent piston 96 from turning. Referring to FIGS. 6A-6C, several anti-rotation features are included in probe assembly 50. First, piston 96 is coupled to snorkel 98 via a hexagonal hole 704 which is coupled to a mating hexagonal portion 706 of snorkel 98. Further, snorkel 98 includes teeth 708 formed on its base 125 that engage mating teeth 710 formed on upper surface of base 105 of stem 92. In order for the teeth 708, 710 to remain engaged during the application of torque, an engaging force is generated by the pressure charge in probe retract accumulator 182 (described more fully below). An additional anti-rotation feature includes a tab 712 which extends from the bottom of stem 92 and mates with a slot 714 that is formed at the base 90*c* of aperture 90 in mandrel 54*b*, as shown in FIG. 5.

During assembly of pad/skirt combination, the portion under skirt 145 between seals 156 and 157 is maintained at atmospheric pressure. That is, seals 156 and 157 seal that portion of the skirt 145 from the annulus drilling fluid that is present outside of probe assembly 50. The differential pressure between the annulus 150 and the sealed region under skirt 145 that is at atmospheric pressure is used to lock pad 140 and skirt 145 to extending portion 119 of piston 96. Three locking mechanisms are present, two of which are created by the differential pressure. One locking mechanism exists because the force generated between skirt 145 and extending portion 119 due to the differential pressure creates a frictional force between the surfaces in contact, thereby inhibiting rotation. The second locking mechanism is the frictional force created by the elastomeneric seal 156 as it attempts to extrude into the region of atmospheric pressure. An additional locking mechanism arises from the use of a Spiralock (™) thread form used on the female thread of the piston extension 119 that engages the male thread 147 of the skirt 145.

Pad 140 is preferably made of an elastomeric material. To provide a good seal, it is preferred that the material of seal pad 140 have a high elongation characteristic. At the same time, it is preferred that the material be relatively hard and wear resistant. More particularly, the material should have an elongation % equal to at least 200% and more preferably over 300%. A durometer hardness of 70 Shore A or greater is preferred. A compromise in one or both of these material properties will sometimes be necessary for particular applications. One such material useful in this application is Hydrogenated Nitrile Butadiene Rubber (HNBR). A material found particularly useful for pad 140 is HNBR compound number 372 supplied by Eutsler Technical Products of Houston, Tex. having a durometer hardness of 85 Shore A and a percent elongation of 370% at room temperature.

Figure 7:
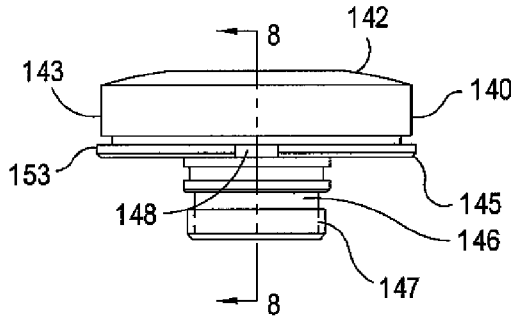
FIG. 7 is an elevation view of the probe pad mounted on the skirt as a preferred embodiment employed in the formation probe assembly shown in FIGS. 4 and 5.
Figure 8:
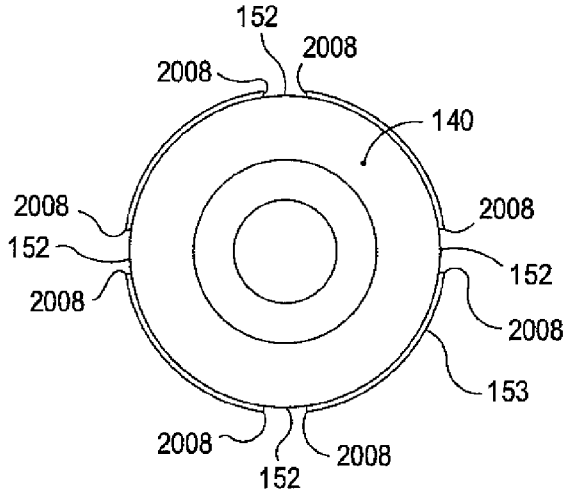
FIG. 8 is a top view of the probe pad shown in FIG. 7.
Figure 9:
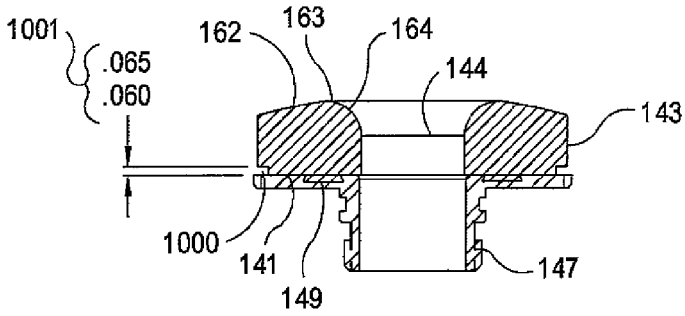
FIG. 9 is a cross-sectional view of the probe pad and skirt taken along line A-A in FIG. 7.

It is important that the profile of seal pad 140 provide sufficient contact stress to provide a good seal and, at the same time, low enough strain that the seal material is not fatigued. One preferred profile for pad 140 is shown in FIGS. 7-9. Sealing surface 142 of pad 140 generally includes a spherical surface 162 and radius surface 164. Spherical surface 162 begins at edge 143 and extends to point 163 where spherical surface 162 merges into and thus becomes a part of radius surface 164. Radius surface 164 curves into central aperture 144 which passes through the center of the pad 140. In the embodiment shown in FIGS. 7-9, pad 140 includes an overall diameter of 2.25 inches with the diameter of central aperture 144 being equal to 0.75 inches. Radius surface 164 has a radius of 0.25 inches, and spherical surface 162 has a spherical radius equal to 4.25 inches. The height of the profile of pad 140 is 0.53 inches at its thickest point.

In another embodiment for pad 140, pad 140*a* is shown in FIGS. 23-27 having a different profile from pad 140. Sealing surface 2000 of pad 140*a* generally includes a cylindrical surface 2000, outer radius surface 2001 and inner radius surface 2004. Cylindrical surface 2000 begins at edge 2005 and extends to edge 2006 where cylindrical surface 2000 merges into and thus becomes a part of inner radius surface 2004. Radius surface 2004 curves into central aperture 2007, which passes through the center of the pad 140*a*. Cylindrical surface 2000 also merges with outer radius surface 2001 at edge 2006. In the embodiment shown in FIGS. 23-27, pad 140*a* includes an overall diameter of 2.25 inches with the diameter of central aperture 2007 being equal to 0.75 inches. Outer radius surface 2001 has a radius of 0.25 inches. Inner radius surface 2004 has a radius of 0.188 inches, and cylindrical surface 2000 has a radius equal to 4.25 inches. The height of the profile of pad 140*a* is 0.53 inches at its thickest point. The pad 140*a* is preferably oriented to borehole 8 such that the cylindrical shape of the pad is aligned to the borehole cylindrical shape.

Turning back to FIGS. 7-9, when pad 140 is compressed, it extrudes into the recesses 152 in skirt 145. The corners 2008 of the recesses 152 can damage the pad, resulting in premature failure. An undercut feature 1000 shown in FIGS. 7 and 9 is cut into the pad to give space between the elastomeric pad 140 and the recesses 152. In the preferred embodiment, the undercut is 0.060 inches wide (1001) and has a diameter (1002) of 2.090 inches.

Figure 9A:
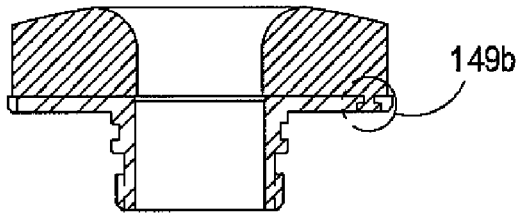
FIG. 9A is a cross-sectional view of an alternative embodiment of the probe pad and skirt shown in FIG. 7, with the cross-section taken along line B-B in FIG. 9B.
Figure 9B:
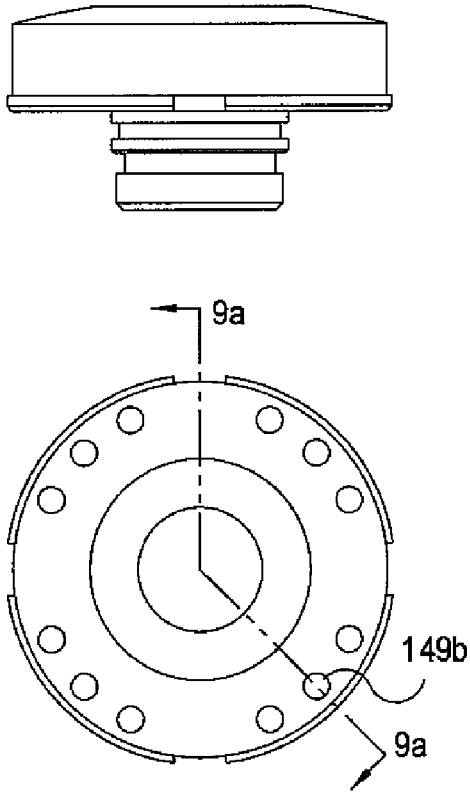
FIG. 9B is a top view, in partial cross-section, of the probe pad and skirt shown in FIG. 9A.

As best shown in FIGS. 7 and 9, skirt 145 includes an extension 146 for threadingly engaging extending portion 119 of piston 96 (FIG. 5) at threaded segment 147 (FIG. 7 and 9). In the preferred embodiment, skirt 145 also includes dovetail groove 149*a* as shown in FIG. 9. When molded, the elastomer fills the dovetail groove. The groove acts to retain the elastomer in the event of de-bonding between the metal skirt 145 and the pad 140. In another embodiment, a plurality of counterbores 149*b* (FIGS. 9*a* and 9*b*) in skirt 145 act to retain the elastomer. When molded, the elastomer fills the counterbores. As shown in FIG. 5, snorkel extension 126 supports the central aperture 144 of pad 140 (FIG. 7) to reduce the extrusion of the elastomer when it is pressed against the borehole wall during a formation test. Reducing extrusion of the elastomer helps to ensure a good pad seal, especially against the high differential pressure seen across the pad during a formation test.

To help with a good pad seal, tool 10 may include, among other things, centralizers for centralizing the formation probe assembly 50 and thereby normalizing pad 140 relative to the borehole wall. For example, the formation tester may include centralizing pistons coupled to a hydraulic fluid circuit configured to extend the pistons in such a way as to protect the probe assembly and pad, and also to provide a good pad seal. A formation tester including such devices is described in provisional Patent Application No. 60/381,258 filed May 17, 2002, entitled Apparatus and Method for MWD Formation Testing, and in the patent application filed concurrently herewith via Express Mail No. EV 324573678 US and entitled Apparatus and Method for MWD Formation Testing, which claims priority to the previously referenced provisional application, both applications hereby incorporated by reference herein for all purposes.

Figure 10:
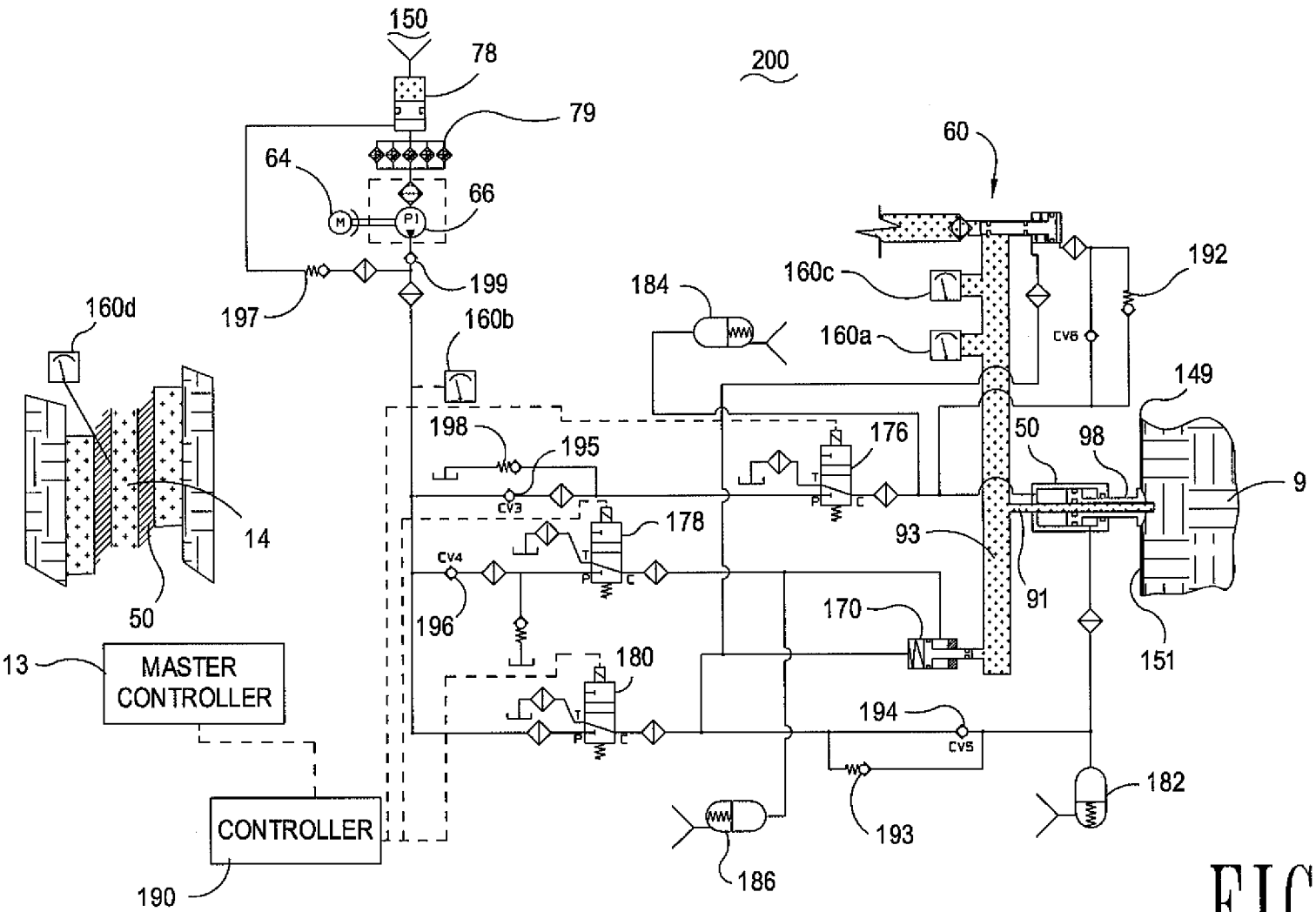
FIG. 10 is a schematic view of a hydraulic circuit employed in actuating the formation tester apparatus.

The hydraulic circuit 200 used to operate probe assembly 50, equalizer valve 60 and draw down piston 170 is shown in FIG. 10. A microprocessor-based controller 190 is electrically coupled to all of the controlled elements in the hydraulic circuit 200 illustrated in FIG. 10, although the electrical connections to such elements are conventional and are not illustrated other than schematically. Controller 190 is located in electronics module 30 in housing section 12*a*, although it could be housed elsewhere in bottom hole assembly 6. Controller 190 detects the control signals transmitted from a master controller (not shown) housed in the MWD sub 13 of the bottom hole assembly 6 which, in turn, receives instructions transmitted from the surface via mud pulse telemetry, or any of various other conventional means for transmitting signals to downhole tools.

When controller 190 receives a command to initiate formation testing, the drill string has stopped rotating. As shown in FIG. 10, motor 64 is coupled to pump 66 which draws hydraulic fluid out of hydraulic reservoir 78 through a serviceable filter 79. As will be understood, the pump 66 directs hydraulic fluid into hydraulic circuit 200 that includes formation probe assembly 50, equalizer valve 60, draw down piston 170 and solenoid valves 176, 178, 180.

The operation of formation tester 10 is best understood in reference to FIG. 10 in conjunction with FIGS. 3A, 5 and 6. In response to an electrical control signal, controller 190 energizes solenoid valve 180 and starts motor 64. Pump 66 then begins to pressurize hydraulic circuit 200 and, more particularly, charges Probe Retract Accumulator 182. The act of charging accumulator 182 also ensures that the probe assembly 50 is retracted and that drawdown piston 170 is in its initial shouldered position as shown in FIG. 3A. When the pressure in system 200 reaches a predetermined value, such as 1800 p.s.i. as sensed by pressure transducer 160*b*, controller 190 (which continuously monitors pressure in the system) energizes solenoid valve 176 and de-energizes solenoid valve 180 which causes probe piston 96 and snorkel 98 to begin to extend toward the borehole wall 151. Concurrently, check valve 194 and relief valve 193 seal the probe retract accumulator 182 at a pressure charge of between approximately 500 to 1250 p.s.i.

Piston 96 along with snorkel 98 extend from the position shown in FIG. 6A to that shown in FIG. 6B where pad 140 engages the mud cake 49 on borehole wall 151. With hydraulic pressure continued to be supplied to the extend side of the piston 96 and snorkel 98, the snorkel then penetrates the mud cake as shown in FIG. 6C. There are two expanded positions of snorkel 98, generally shown in FIGS. 6B and 6C. The piston 96 and snorkel 98 move outwardly together until the pad 140 engages the borehole wall 151. This combined motion continues until the force of the borehole wall against pad 140 reaches a pre-determined magnitude, for example 5,500 lb, causing pad 140 to be squeezed. At this point, a second stage of expansion takes place with snorkel 98 then moving within the cylinder 120 in piston 96 to penetrate the mud cake 49 on the borehole wall 151 and to receive formation fluids.

As seal pad 140 is pressed against the borehole wall, the pressure in circuit 200 rises and when it reaches a predetermined pressure, valve 192 opens so as to close equalizer valve 60, thereby isolating fluid passageway 93 from the annulus. In this manner, valve 192 ensures that valve 60 closes only after the seal pad 140 has entered contact with mud cake 49 which lines borehole wall 151. Passageway 93, now closed to the annulus 150, is in fluid communication with cylinder 175 at the upper end of cylinder 177 in draw down manifold 89, best shown in FIG. 3A.

With solenoid valve 176 still energized, probe seal accumulator 184 is charged until the system reaches a predetermined pressure, for example 1800 p.s.i., as sensed by pressure transducer 160*b*. When that pressure is reached, controller 190 energizes solenoid valve 178 to begin drawdown. Energizing solenoid valve 178 permits pressurized fluid to enter portion 172*a* of cylinder 172 causing draw down piston 170 to retract. When that occurs, plunger 174 moves within cylinder 177 such that the volume of fluid passageway 93 increases by the volume of the area of the plunger 174 times the length of its stroke along cylinder 177. The volume of cylinder 175 is increased by this movement, thereby increasing the volume of fluid passageway 93. Preferably, these elements are sized such that the volume of fluid passageway 93 is increased by 10 cc as a result of piston 170 being retracted.

As draw down piston 170 is actuated, 10 cc of formation fluid will thus be drawn through central passageway 127 of snorkel 98 and through screen 100. The movement of draw down piston 170 within its cylinder 172 lowers the pressure in closed passageway 93 to a pressure below the formation pressure, such that formation fluid is drawn through screen 100 and snorkel 98 into aperture 101, then through stem passageway 108 to passageway 91 that is in fluid communication with passageway 93 and part of the same closed fluid system. In total, fluid chambers 93 (which include the volume of various interconnected fluid passageways, including passageways in probe assembly 50, passageways 85, 93 [FIG. 3], the passageways interconnecting 93 with draw down piston 170 and pressure transducers 160*a,c*) preferably has a volume of approximately 40 cc. Drilling mud in annulus 150 is not drawn into snorkel 98 because pad 140 seals against the mud cake. Snorkel 98 serves as a conduit through which the formation fluid may pass and the pressure of the formation fluid may be measured in passageway 93 while pad 140 serves as a seal to prevent annular fluids from entering the snorkel 98 and invalidating the formation pressure measurement.

Referring momentarily to FIGS. 5 and 6C, formation fluid is drawn first into the central bore 132 of screen 100. It then passes through slots 134 in screen slotted segment 133 such that particles in the fluid are filtered from the flow and are not drawn into passageway 93. The formation fluid then passes between the outer surface of screen 100 and the inner surface of snorkel extension 126 where it next passes through apertures 123 in screen 100 and into the central passageway 108 of stem 92 by passing through apertures 101 and central passage bore 103 of scraper 102.

Referring again to FIG. 10, with seal pad 140 sealed against the borehole wall, check valve 195 maintains the desired pressure acting against piston 96 and snorkel 98 to maintain the proper seal of pad 140. Additionally, because probe seal accumulator 184 is fully charged, should tool 10 move during drawdown, additional hydraulic fluid volume may be supplied to piston 96 and snorkel 98 to ensure that pad 140 remains tightly sealed against the borehole wall. In addition, should the borehole wall 151 move in the vicinity of pad 140, the probe seal accumulator 184 will supply additional hydraulic fluid volume to piston 96 and snorkel 98 to ensure that pad 140 remains tightly sealed against the borehole wall 151. Without accumulator 184 in circuit 200, movement of the tool 10 or borehole wall 151, and thus of formation probe assembly 50, could result in a loss of seal at pad 140 and a failure of the formation test.

With the drawdown piston 170 in its fully retracted position and 10 cc of formation fluid drawn into closed system 93, the pressure will stabilize enabling pressure transducers 160*a,c* to sense and measure formation fluid pressure. The measured pressure is transmitted to the controller 190 in the electronic section where the information is stored in memory and, alternatively or additionally, is communicated to the master controller in the MWD tool 13 below formation tester 10 where it can be transmitted to the surface via mud pulse telemetry or by any other conventional telemetry means When drawdown is completed, piston 170 actuates a contact switch 320 mounted in endcap 400 and piston 170, as shown in FIG. 3A. The drawdown switch assembly consists of contact 300, wire 308 which is coupled to contact 300, plunger 302, spring 304, ground spring 306, and retainer ring 310. Piston 170 actuates switch 320 by causing plunger 302 to engage contact 300 which causes wire 308 to couple to system ground via contact 300 to plunger 302 to ground spring 306 to piston 170 to endcap 400 which is in communication with system ground (not shown).

When the contact switch 320 is actuated controller 190 responds by shutting down motor 64 and pump 66 for energy conservation. Check valve 196 traps the hydraulic pressure and maintains piston 170 in its retracted position. In the event of any leakage of hydraulic fluid that might allow piston 170 to begin to move toward its original shouldered position, drawdown accumulator 186 will provide the necessary fluid volume to compensate for any such leakage and thereby maintain sufficient force to retain piston 170 in its retracted position.

During this interval, controller 190 continuously monitors the pressure in fluid passageway 93 via pressure transducers 160*a,c*. When the measured pressure stabilizes, or after a predetermined time interval, controller 190 de-energizes solenoid valve 176. When this occurs, pressure is removed from the close side of equalizer valve 60 and from the extend side of probe piston 96. Spring 58 will return the equalizer valve 60 to its normally open state and probe retract accumulator 182 will cause piston 96 and snorkel 98 to retract, such that seal pad 140 becomes disengaged with the borehole wall. Thereafter, controller 190 again powers motor 64 to drive pump 66 and again energizes solenoid valve 180. This step ensures that piston 96 and snorkel 98 have fully retracted and that the equalizer valve 60 is opened. Given this arrangement, the formation tool has a redundant probe retract mechanism. Active retract force is provided by the pump 66. A passive retract force is supplied by probe retract accumulator 182 that is capable of retracting the probe even in the event that power is lost. It is preferred that accumulator 182 be charged at the surface before being employed downhole to provide pressure to retain the piston and snorkel in housing 12*c*.

Referring again briefly to FIGS. 5, 6, as piston 96 and snorkel 98 are retracted from their position shown in FIG. 6C to that of FIG. 6B, screen 100 is drawn back into snorkel 98. As this occurs, the flange on the outer edge of scraper 102 drags and thereby scrapes the inner surface of screen member 100. In this manner, material screened from the formation fluid upon its entering of screen 100 and snorkel 98 is removed from screen 100 and deposited into the annulus 150. Similarly, scraper 102 scrapes the inner surface of screen member 100 when snorkel 98 and screen 100 are extended toward the borehole wall.

After a predetermined pressure, for example 1800 p.s.i., is sensed by pressure transducer 160*b* and communicated to controller 190 (indicating that the equalizer valve is open and that the piston and snorkel are filly retracted), controller 190 de-energizes solenoid valve 178 to remove pressure from side 172*a* of drawdown piston 170. With solenoid valve 180 remaining energized, positive pressure is applied to side 172*b* of drawdown piston 170 to ensure that piston 170 is returned to its original position (as shown in FIG. 3). Controller 190 monitors the pressure via pressure transducer 160*b* and when a predetermined pressure is reached, controller 190 determines that piston 170 is fully returned and it shuts off motor 64 and pump 66 and de-energizes solenoid valve 180. With all solenoid valves 176, 178, 180 returned to their original position and with motor 64 off, tool 10 is back in its original condition and drilling can again be commenced.

Relief valve 197 protects the hydraulic system 200 from overpressure and pressure transients. Various additional relief valves may be provided. Thermal relief valve 198 protects trapped pressure sections from overpressure. Check valve 199 prevents back flow through the pump 66.

Figure 11:
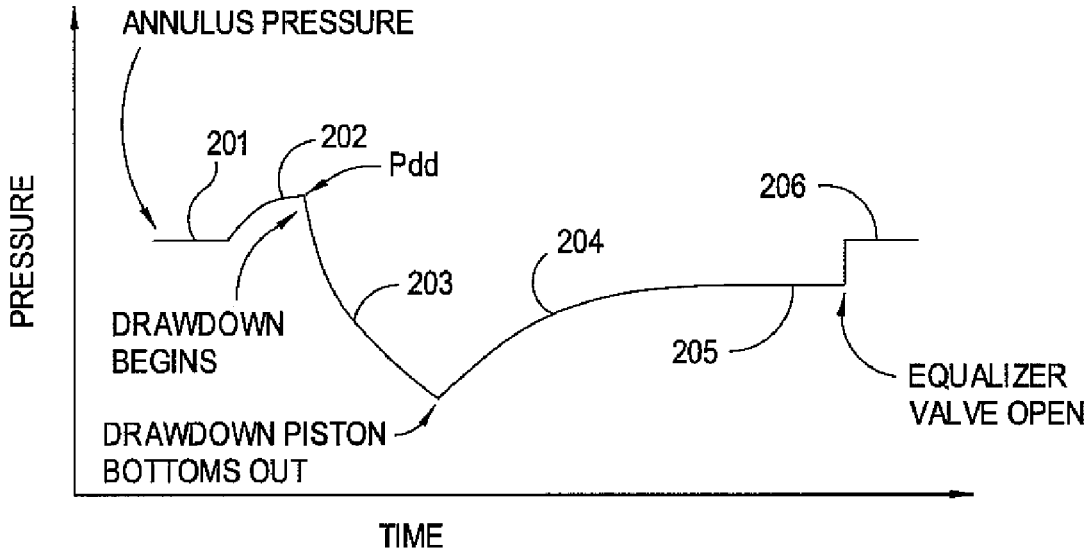
FIG. 11 is a graph of the formation fluid pressure as compared to time measured during operation of the tester apparatus.

Referring to FIG. 11, there is shown a pressure versus time graph illustrating in a general way the pressure sensed by pressure transducer 160*a,c* during the operation of formation tester 10. As the formation fluid is drawn within the tester, pressure readings are taken continuously by transducer 160*a, c*. The sensed pressure will initially be equal to the annulus pressure shown at point 201. As pad 140 is extended and equalizer valve 60 is closed, there will be a slight increase in pressure as shown at 202. This occurs when the pad 140 seals against the borehole wall 151 and squeezes the drilling fluid trapped in the now-isolated passageway 93. As drawn down piston 170 is actuated, the volume of the closed chamber 93 increases, causing the pressure to decrease as shown in region 203. When the drawn down piston bottoms out within cylinder 172, a differential pressure with the formation fluid exists causing the fluid in the formation to move towards the low pressure area and, therefore, causing the pressure to build over time as shown in region 204. The pressure begins to stabilize, and at point 205, achieves the pressure of the formation fluid in the zone being tested. After a fixed time, such as three minutes after the end of region 203, the equalizer valve 60 is again opened, and the pressure within chamber 93 equalizes back to the annulus pressure as shown at 206.

Referring again to FIG. 10, the formation test tool 10 preferably includes four pressure transducers 160: two quartz crystal gauges 160*a*, 160*d*, a strain gauge 160*c*, and a differential strain gage 160*b*. One of the quartz crystal gauges 160*a* is in communication with the annulus mud and also senses formation pressures during the formation test. The other quartz crystal gauge 160*d* is in communication with the flowbore 14 at all times. In addition, both quartz crystal gauges 160*a* and 160*d* have temperature sensors associated with the crystals. The temperature sensors are necessary to compensate the pressure measurement for thermal effects. The temperature sensors are also used to measure the temperature of the fluids near the pressure transducers. For example, the temperature sensor associated with quartz crystal gauge 160*a* is used to measure the temperature of the fluid near the gage in chamber 93. The third transducer is a strain gauge 160*c* and is in communication with the annulus mud and also senses formation pressures during the formation test. The quartz transducers 160*a,d* provide accurate, steady-state pressure information, whereas the strain gauge 160*c* provides faster transient response. The increased response sensitivity exhibited by the strain gauge 160*c* comes at the cost of lower accuracy when compared to the quartz gauges. Thus, each type of transducer provides some advantage over the other.

When the formation tester 10 is not in use, the quartz transducers 160*a,d* operatively measure pressure while drilling to serve as a pressure while drilling tool. By comparison, the strain gauge 160*c* transducer provides quicker response to transients of the type witnessed during a formation test. In performing the sequencing during the formation test, chamber 93 is closed off and both the annulus quartz gauge 160*a* and the strain gauge 160*c* measure pressure within the closed chamber 93. The strain gauge transducer 160*c* essentially is used to supplement the quartz gauge 160*a* measurements.

Figure 12:
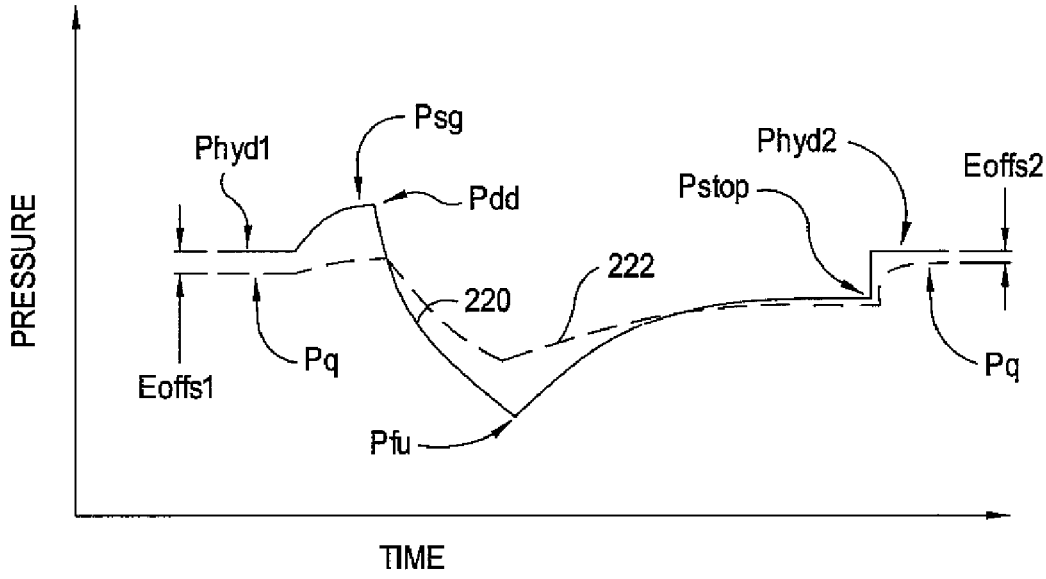
FIG. 12 is another graph of the formation fluid pressure as compared to time measured during operation of the tester apparatus and showing pressures measured by different pressure transducers employed in the formation tester.

Referring now to FIG. 12, representative formation test pressure curves in accordance with a preferred embodiment are shown. The solid curve 220 represents pressure readings Psg detected and transmitted by the strain gauge 160*c*. Similarly, the pressure Pq, indicated by the quartz gauge 160*a*, is shown as a dashed line 222. As noted above, strain gauge transducers generally do not offer the accuracy exhibited by quartz transducers and quartz transducers do not provide the transient response offered by strain gauge transducers. Hence, the instantaneous formation test pressures indicated by the strain gauge 160*c* and quartz 160*a* transducers are likely to be different. For example, at the beginning of a formation test, the pressure readings Phyd1 indicated by the quartz transducer Pq and the strain gauge Psg transducer are different and the difference between these values is indicated as Eoffs1 in FIG. 12.

With the assumption that the quartz gauge reading Pq is the more accurate of the two readings, the actual formation test pressures may be calculated by adding or subtracting the appropriate offset error Eoffs1 to the pressures indicated by the strain gauge Psg for the duration of the formation test. In this manner, the accuracy of the quartz transducer and the transient response of the strain gauge may both be used to generate a corrected formation test pressure that, where desired, is used for real-time calculation of formation characteristics.

As the formation test proceeds, it is possible that the strain gauge readings may become more accurate or for the quartz gauge reading to approach actual pressures in the pressure chamber even though that pressure is changing. In either case, it is probable that the difference between the pressures indicated by the strain gauge transducer and the quartz transducer at a given point in time may change over the duration of the formation test. Hence, it may be desirable to consider a second offset error that is determined at the end of the test where steady state conditions have been resumed. Thus, as pressures Phyd2 level off at the end of the formation test, it may be desirable to calculate a second offset error Eoffs2. This second offset error Eoffs2 might then be used to provide an after-the-fact adjustment to the formation test pressures.

The offset values Eoffs1 and Eoffs2 may be used to adjust specific data points in the test. For example, all critical points up to Pfu might be adjusted using errors Eoffs1, whereas all remaining points might be adjusted offset using error Eoffs2. Another solution may be to calculate a weighted average between the two offset values and apply this single weighted average offset to all strain gauge pressure readings taken during the formation test. Other methods of applying the offset error values to accurately determine actual formation test pressures may be used accordingly and will be understood by those skilled in the art.

In the preferred embodiment, the formation test tool 10 can operate in two general modes: pump-on operation and pump-off operation. During pump on operation, mud pumps on the surface pump drilling fluid through the drill string 6 and back up the annulus 150. Using that column of drilling fluid, the tool 10 can transmit data to the surface using mud pulse telemetry during the formation test. Mud pulse telemetry downlink commands from the surface can also be received by the tool 10. During a formation test, the drillpipe and formation test tool are not rotated. However, it may be the case that an immediate movement or rotation of the drill string will be necessary. As a failsafe feature, at any time during the formation test, an abort command can be transmitted from surface to the formation test tool 10. In response to this abort command, the formation test tool will immediately discontinue the formation test and retract the probe piston to its normal, retracted position for drilling. The drill pipe can then be moved or rotated without causing damage to the formation test tool.

During pump-off operation, a similar failsafe feature may also be active. The formation test tool 10 and/or MWD tool 13 are preferably adapted to sense when the mud flow pumps are turned on. Consequently, the act of turning on the pumps and reestablishing flow through the tool may be sensed by pressure transducer 160*d* or by other pressure sensors in bottom hole assembly 6. This signal will be interpreted by a controller in the MWD tool 13 or other control and communicated to controller 190 which is programmed to automatically trigger an abort command in the formation test tool 10. At this point, the formation test tool 10 will immediately discontinue the formation test and retract the probe piston to its normal position for drilling. The drill pipe can then be moved or rotated without causing damage to the formation test tool.

The uplink and downlink commands are not limited to mud pulse telemetry. By way of example and not by way of limitation, other telemetry systems may include manual methods, including pump cycles, flow/pressure bands, pipe rotation, or combinations thereof. Other possibilities include electromagnetic (EM), acoustic, and wireline telemetry methods. An advantage to using alternative telemetry methods lies in the fact that mud pulse telemetry (both uplink and downlink) requires pump-on operation but other telemetry systems do not. The failsafe abort command may therefore be sent from the surface to the formation test tool using an alternative telemetry system regardless of whether the mud flow pumps are on or off.

The down hole receiver for downlink commands or data from the surface may reside within the formation test tool or within an MWD tool 13 with which it communicates. Likewise, the down hole transmitter for uplink commands or data from down hole may reside within the formation test tool 10 or within an MWD tool 13 with which it communicates. In the preferred embodiment specifically described, the receivers and transmitters are each positioned in MWD tool 13 and the receiver signals are processed, analyzed and sent to a master controller in the MWD tool 13 before being relayed to local controller 190 in formation testing tool 10.

Commands or data sent from surface to the formation test tool can be used for more than transmitting a failsafe abort command. The formation test tool can have many preprogrammed operating modes. A command from the surface may be used to select the desired operating mode. For example, one of a plurality of operating modes may be selected by transmitting a header sequence indicating a change in operating mode followed by a number of pulses that correspond to that operating mode. Other means of selecting an operating mode will certainly be known to those skilled in the art.

In addition to the operating modes heretofore discussed, other information may be transmitted from the surface to the formation test tool 10. This information may include critical operational data such as depth or surface drilling mud density. The formation test tool may use this information to help refine measurements or calculations made downhole or to select a preferred operating mode. Commands from the surface might also be used to program the formation test tool to perform in a mode that is not preprogrammed.

Figure 13:
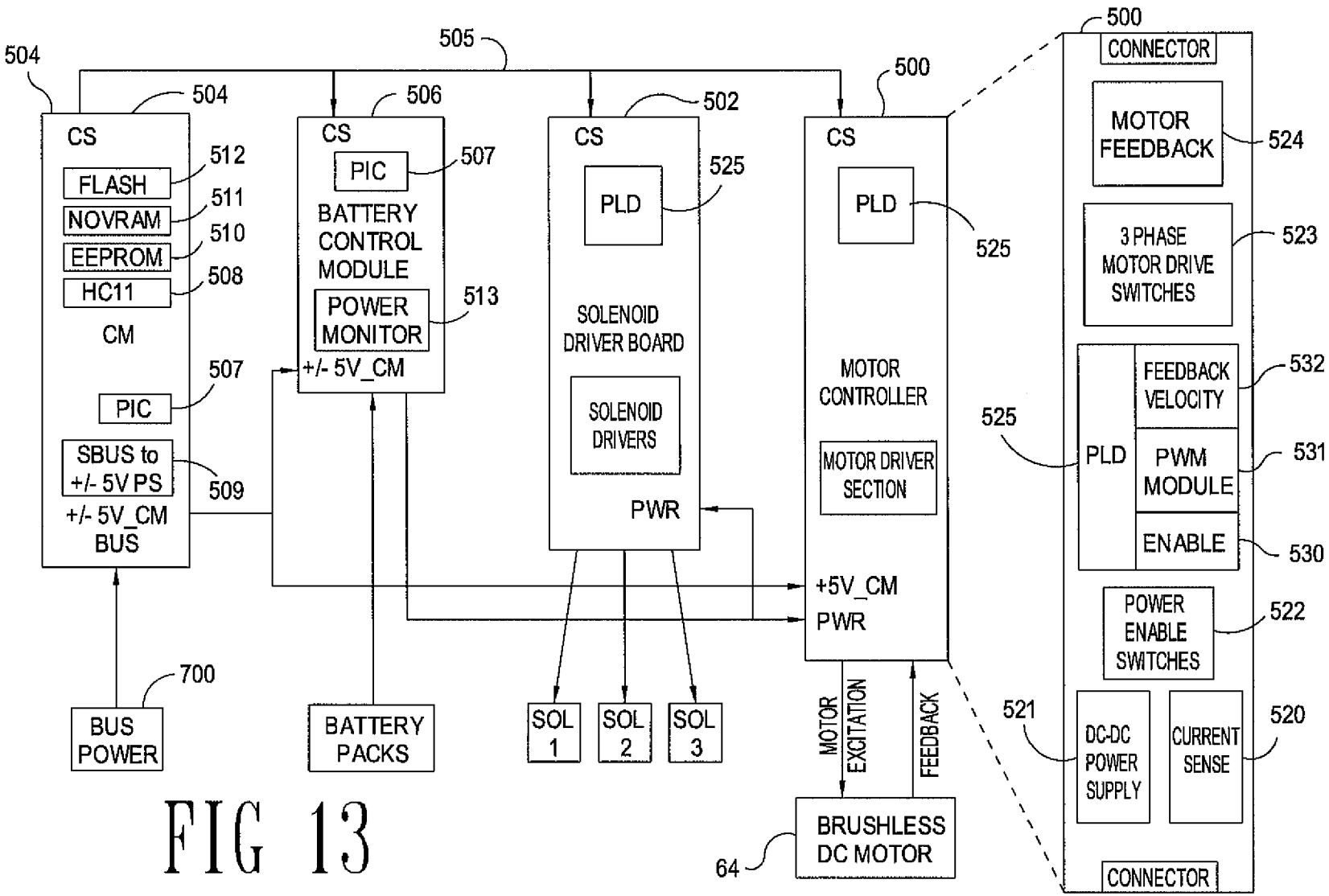
FIG. 13 is a schematic diagram showing the preferred electronics used in the formation tester.

Turning to FIG. 13, a description of the operational characteristics of the preferred motor controller used in the formation testing while drilling (FTWD) tool 10 will be discussed. FIG. 13 shows a representative schematic of the preferred power distribution to the motor controller 500, and incidentally, to the solenoid driver 502. FIG. 13 also includes a control module 504 and battery control module 506. The solenoid driver is preferably configured to transmit actuating signals to solenoids 176, 178, 180 that control the position of valves and/or pistons within hydraulics system shown in FIG. 10 and previously described. Similarly, the motor controller 500 transmits motor excitation signals that control the operation of brushless DC motor 64. This motor 64 preferably controls the hydraulic pressure within the formation tester via a hydraulic pump 66.

Bus power 700 is preferably directed to the motor controller 500 from the control module 504 over a communications bus 505. Bus power 700 is drawn from the common sub bus used for all the MWD tools 13 in bottom hole assembly 6. The control module 504 and battery control module 506 may include any of a variety of micro controllers such as the PIC 507 or HC11 508 chips shown in FIG. 13. The control module 504 may also include any memory devices for storing operating settings, data, executable instructions or other information. As such, the memory devices might include a programmable memory device 510, a nonvolatile memory device 511, or a flash memory device 512.

First, power from a power bus 700 is converted 509 to logic device power levels such as +5V or +3.3V as required. In addition, battery voltage, 88V nominal, is monitored 513 to ensure a level that is adequate to drive the solenoids 176, 178, 180 and brushless DC motor 64. A minimum of 70V is desired. The solenoid driver 502 and the motor controller 500 preferably implement the desired control functions using programmable logic devices (PLDs) 525 such as a field programmable gate array (FPGA) or even an application specific integrated circuit (ASIC) or other complex programmable logic device (CPLD).

A more detailed block diagram of the functional components in the motor controller 500 is shown at the right side of FIG. 13. The motor controller 500 preferably includes five main components: current sense circuitry 520, power supply 521 and power switching 522, PLD 525, motor excitation switches 523, and motor feedback 524. The current sense circuitry 520 detects the high side current drawn by the motor controller 500. The Power Supply 521 is preferably a DC-DC power supply that converts the bus power 700 from the control module 504 to a usable voltage. In the preferred case, voltage is converted from 20V to 12V. The Power Switches 522 include a number of switches controlled by the PLD 525 that will disconnect all power from IC's that are used solely for the motor controller (as in a Sleep Mode). The PLD 525 is preferably used for interfacing with the Control Module 504 and for providing synchronous commutation of a brushless DC motor 64. The motor excitation switches 523 are preferably embodied using a field effect transistor (FET) Bridge. Each phase of a three-phase brushless DC motor is excited through a totem pole of FETs, for a total of 6 FETs and 3 FET drivers. Lastly, the Motor Feedback 524 converts three amplitude modulated Syncro position feedback signals into six digital signals. The PLD 525 converts the six digital signals from the Motor Feedback 524 into three digital signals to indicate rotor position in the brushless DC motor 64. Information pertaining to the rotor versus stator positioning as well as motor velocity are obtained using these signals.

In accordance with the preferred embodiment, the firmware within the Motor Controller PLD 525 consists of conventional generic address decoding, status registers, as well as other capabilities that are unique to controlling the brushless DC motor 64. These additional features preferably include such functions as Enabling and Power On Sequence 530, Pulse Width Modulation and Current Limiting 531, and Position Feedback Decoding and Motor Speed Control 532.

A power sequence bit is preferably incorporated as part of a general hardware enable register 530 within the PLD 525. The power sequence bit and an additional motor bit are used to enable and inhibit the Motor Controller board 500. When brought out of a reset condition, the default mode for the Motor Controller 500 is inhibited and all power switches 522 are open. Once the power sequence bit 531 is enabled, the PLD 525 will close each power switch 522 in the correct sequence. After all power switches 522 are closed and the motor bit is set, the motor will be powered according to the Pulse Width Modulation register 531.

A Pulse Width Modulation register 531 is an eight bit register and is used to regulate the amount of power sent to the motor. For instance, if the Pulse Width Modulation register 531 is set to hexadecimal 80, the signal sent to the FET drivers 523 will be a pulse width modulated signal with a duty cycle of 50%. This method of restricting the power available to the motor is then used in controlling motor speed as well as limiting the current the motor consumes.

Speed control is preferably incorporated by comparing present velocity as represented by the MSB of a 2-byte velocity value with a velocity limit byte. When the velocity of the motor is lower than the value in the velocity limit register, the pulse width percentage is increased. Conversely, when the velocity of the motor is higher than the velocity limit, the pulse width percentage is decreased.

Current limiting works in a similar manner. When high current is detected, as indicated by setting a "high current bit" in a register, the pulse width percentage is lowered until said high current bit is cleared. That is, the pulse width percentage is lowered until the current consumption is under the current limit. If both speed control and current limit are enabled together the current limit preferably has priority. Therefore, the controller will continue to maintain the set speed until the maximum allowable current is reached, at which time the pulse width percentage decreases until the current consumption falls under the limit. After the current falls below the limit, the controller attempts to reach the desired speed. The pulse width modulation and current limiting functions described herein are critical in limiting current draw, thereby advantageously increasing battery life in the downhole tool.

In addition to the above described functions, the motor controller 500 also controls commutational switching of the 3-phase brushless DC motor 64. Successful commutation of a brushless DC motor 64 requires some knowledge of the position of the rotor with respect to the stator Some common schemes include the use of Hall effect sensors, syncro encoders, and even back electromotive force (EMF) generated within the rotor windings themselves to relay rotor position information to a motor controller. In any event, the position of the rotor is necessary to effectively drive the stator windings. As windings are switched on and off, a rotating magnetic pole structure is induced that produces rotor motion due to the attraction of the permanent rotor magnet poles. Thus, rotor position is critical to keep the induced stator poles ahead of the rotor poles.

The position feedback scheme used in the preferred embodiment uses a syncro encoder that rotates in tandem with the motor rotor. The rotor and syncro shaft are preferably coupled together such that the output from the syncro accurately reflects the position of the brushless DC motor rotor. The feedback scheme is shown more clearly in FIG. 14.

Figure 14:
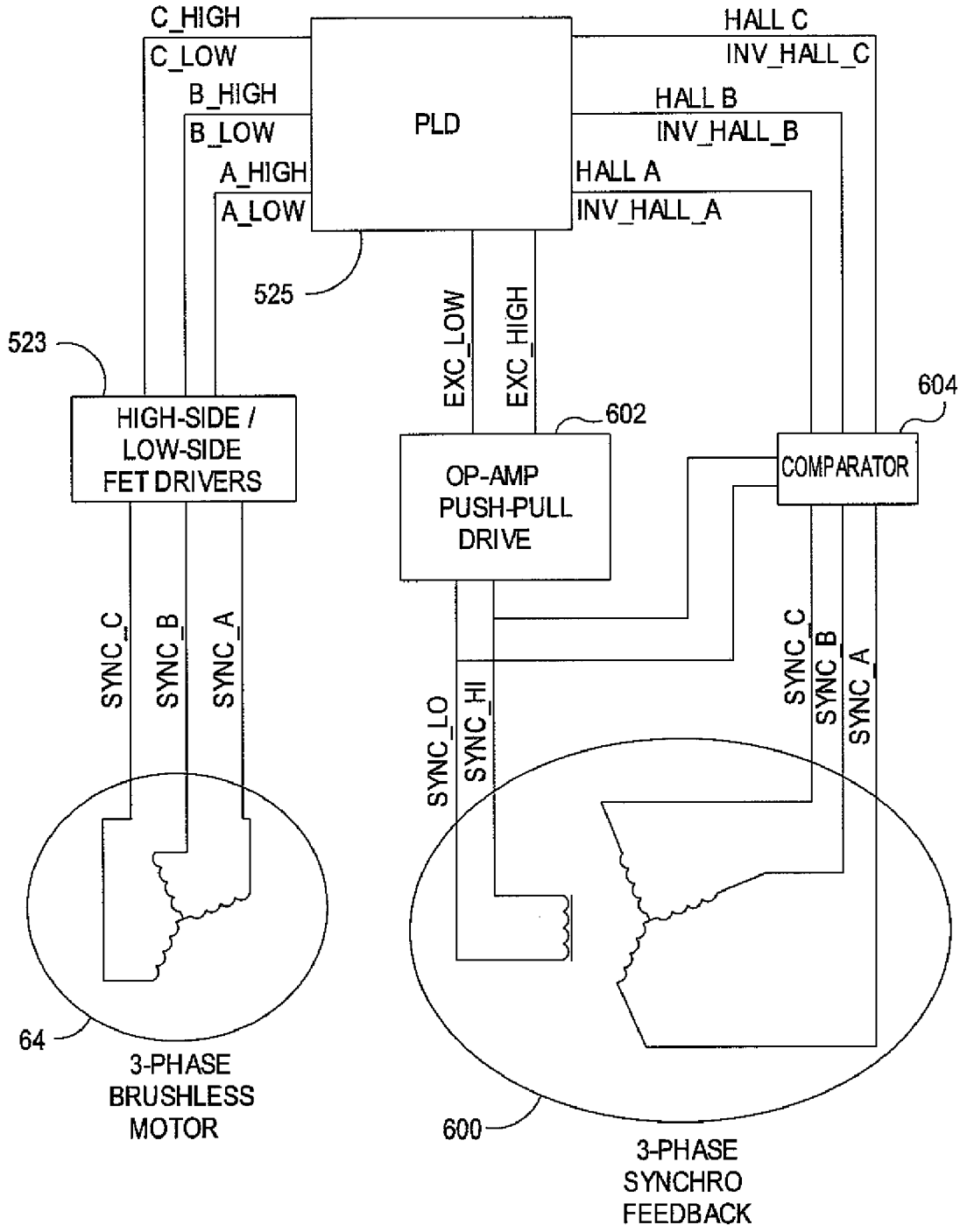
FIG. 14 is a schematic block diagram showing the feedback circuitry employed in the motor control system shown in FIG. 13.

FIG. 14 shows the preferred PLD 525 from FIG. 13 incorporated as a motor controller disposed in a position feedback loop with the three-phase brushless DC motor 64 and a three-phase syncro encoder 600. Position feedback is generated by exciting the Syncro using 32 KHz square waves (Sync_Lo, Sync_Hi) through an op-amp buffer circuitry 602. As the motor rotates, the syncro 600 returns three amplitude-modulated signals, one for each winding, in the syncro corresponding to rotor versus stator position (Sync_A, Sync_B and Sync_C). These signals are then compared 604 with the 32 KHz excitation waveforms. Thus, the comparator 604 converts the signals from analog waveforms to digital signals that are transmitted to the PLD 525.

The digital signals generated by the comparator 604 include two signals for each syncro winding, Hall_N and Inv_Hall_N, where N represents winding A, B, or C. The Hall_N signals are generated by comparing the Sync_N and Syn_Hi signals. Similarly, the Inv_Hall_N signals are generated by comparing the Syn_N and Sync_Lo signals. Thus, where the Sync_Hi and Sync_Lo signals are used as a threshold in the comparisons, the digital output signals Hall_N and Inv_Hall_N are logic high when Sync_N is above Sync_Hi and Sync_Lo, respectively.

Figure 15:
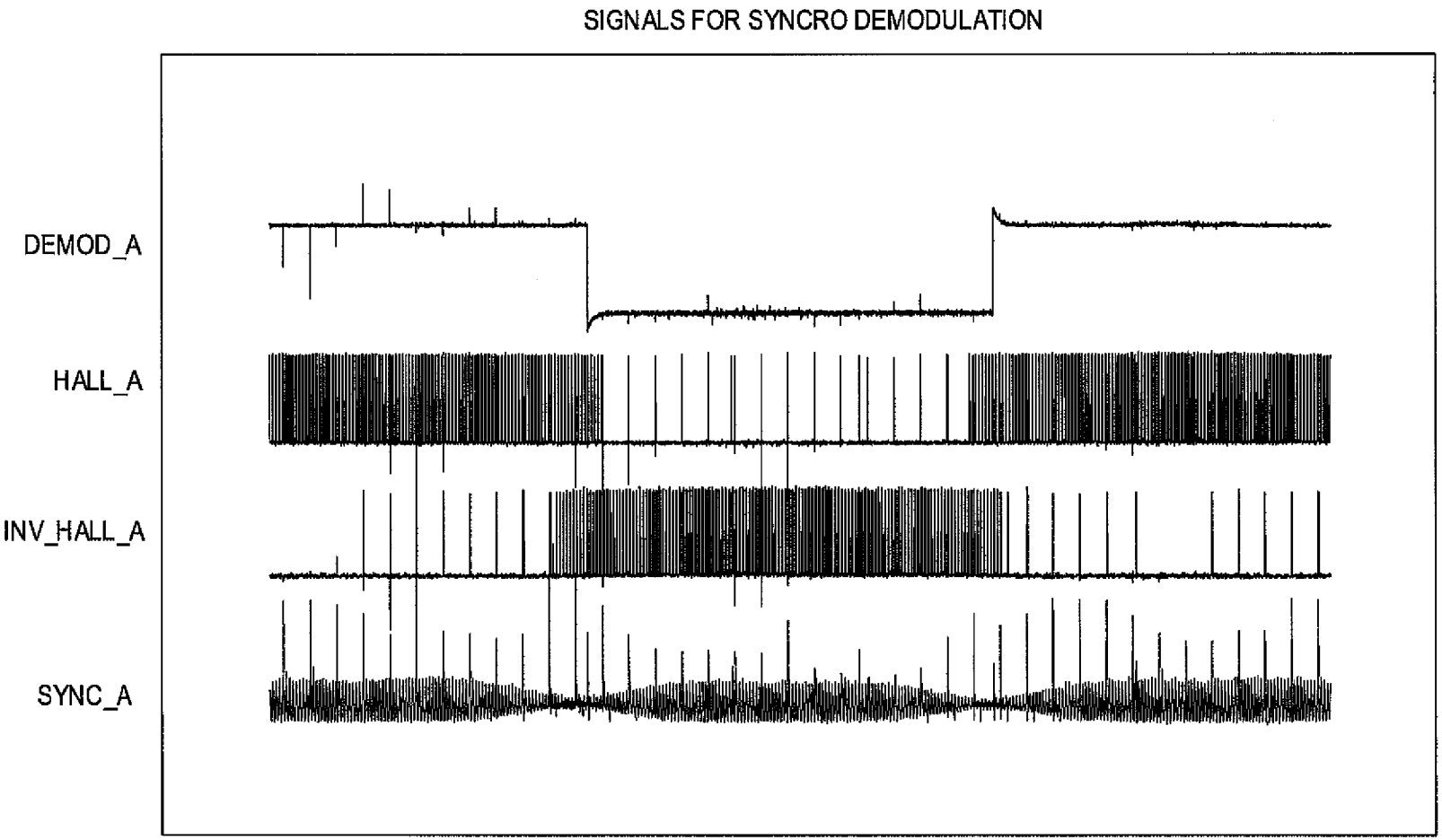
FIG. 15 graphically represents the timing diagram for an electric motor.

The PLD 525 preferably uses the Hall_N and Inv_Hall_N to create a digital Demod_N signal deciphering the exact state for the corresponding phase. A representative timing diagram showing the Sync_N, Hall_N, Inv_Hall_N and Demod_N signals for phase A is shown in FIG. 15. Note that in FIG. 15, the Demod_A signal transitions from a logic high level to a logic low level and back to a logic high level in the time shown. Demod_N signals are similarly generated for each phase and are used by the PLD 525 to determine the state of the motor. This state information may then be used to determine which windings in the brushless DC motor 64 to excite, ground, and float, thereby driving the DC motor. As discussed above, the windings in the brushless DC motor are controlled by switches, preferably embodied as FET drivers 523 that couple the motor windings to the appropriate excitation voltage, or to ground, or to neither (in the floated state).

Figure 16A:
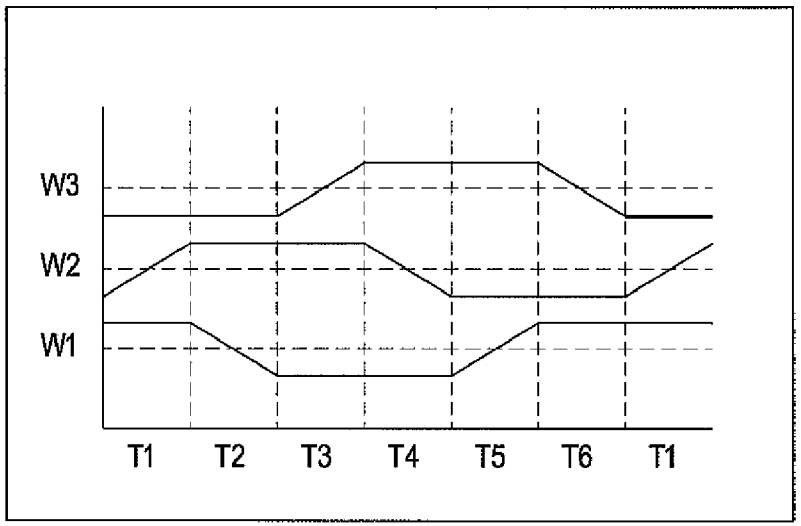
FIGS. 16A and 16B show state tables and timing diagrams indicating the commutational switching of the windings in the motor controlling operation of the formation tester.
Figure 16B:
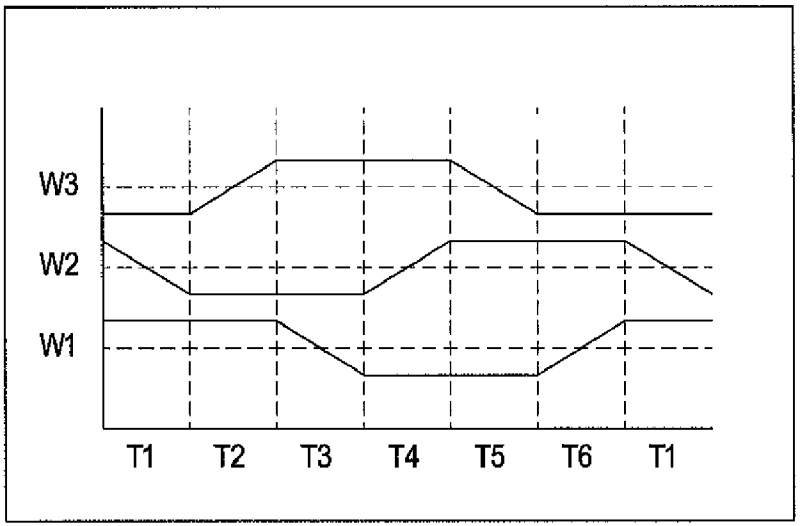
Figure 17:
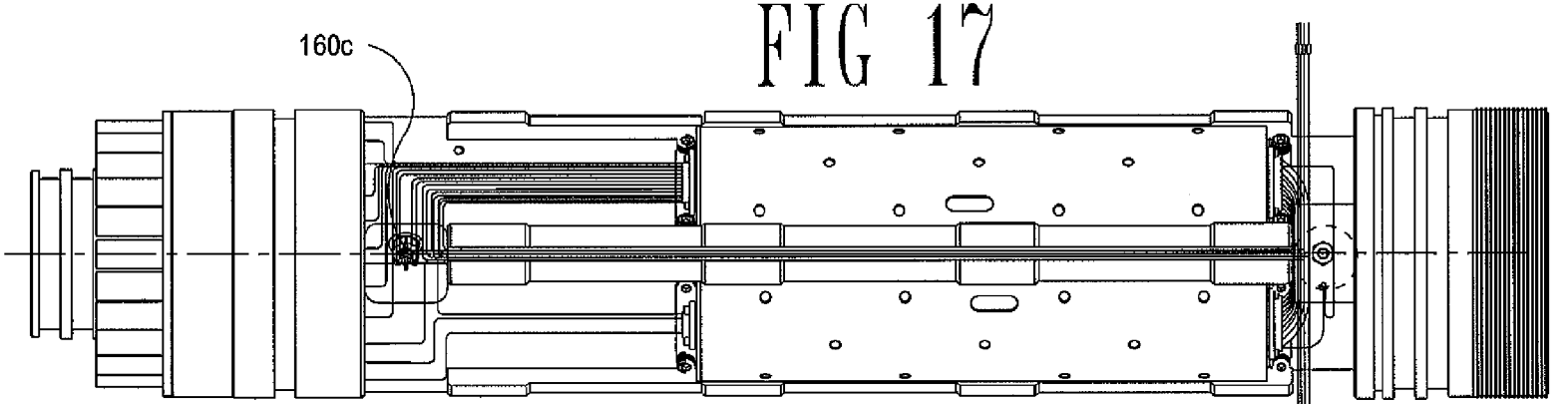
FIGS. 17-22 show various views of the pressure electronics insert assembly of the formation tester.
Figure 18:
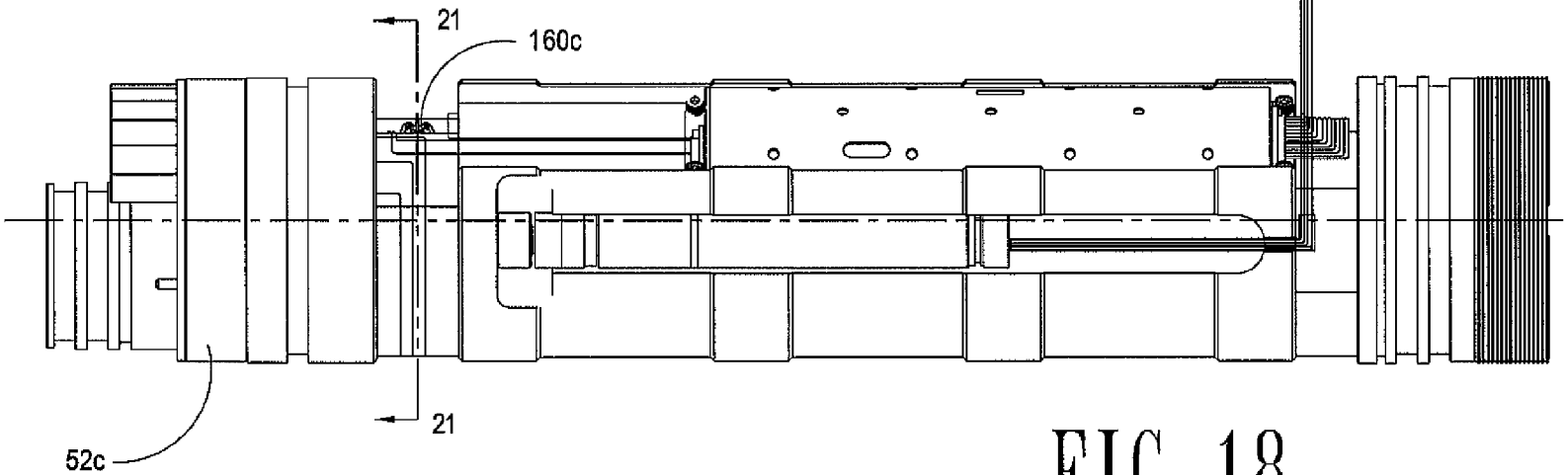
Figure 19:
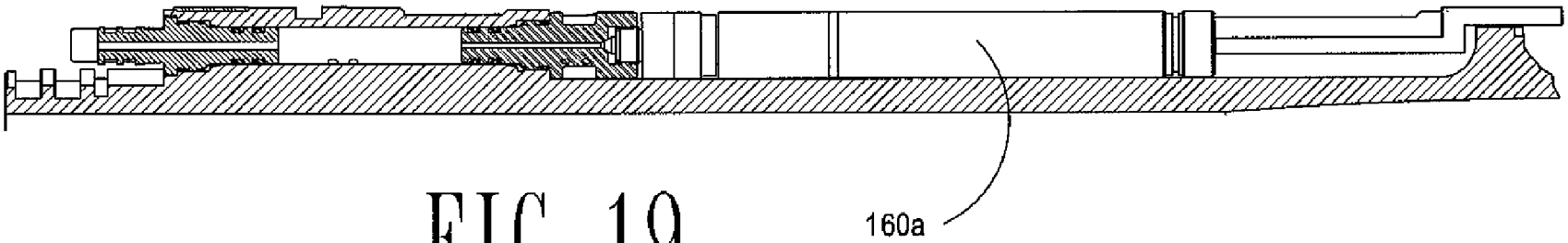
Figure 20:
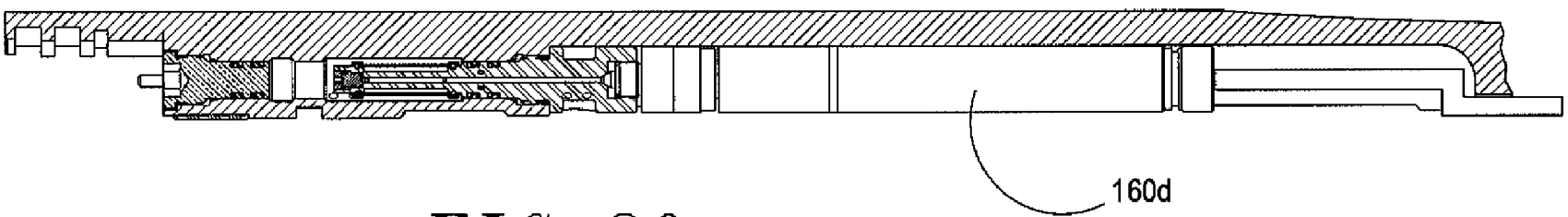
Figure 21:
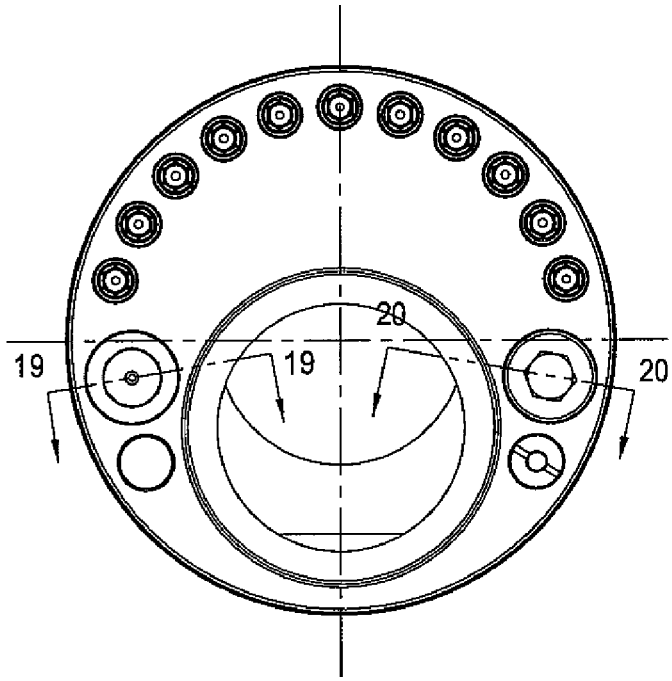
Figure 22:
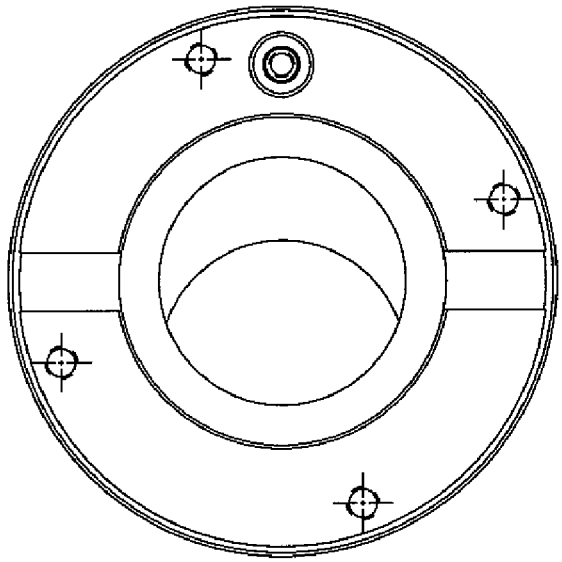
Figure 24:
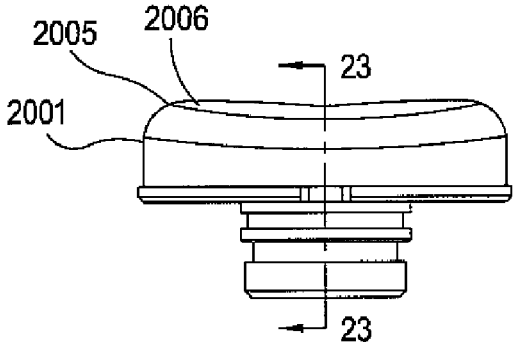
FIGS. 23-27 show various views of alternative embodiments to the probe pad and skirt shown in FIG. 7.
Figure 23:
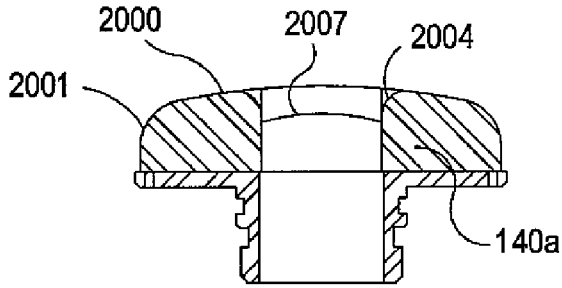
Figure 25:
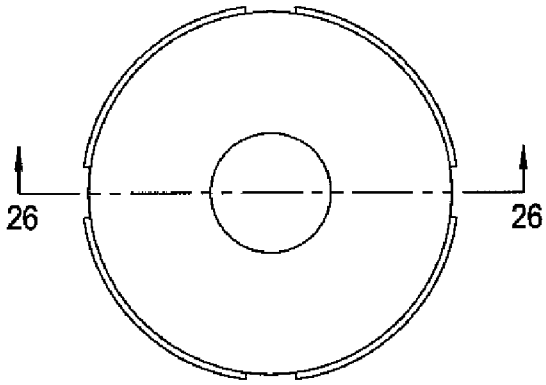
Figure 26:
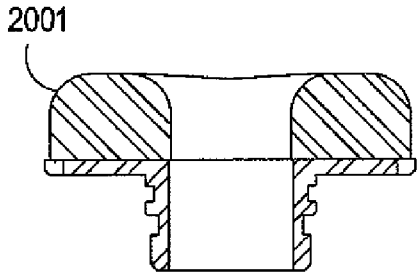
Figure 27:
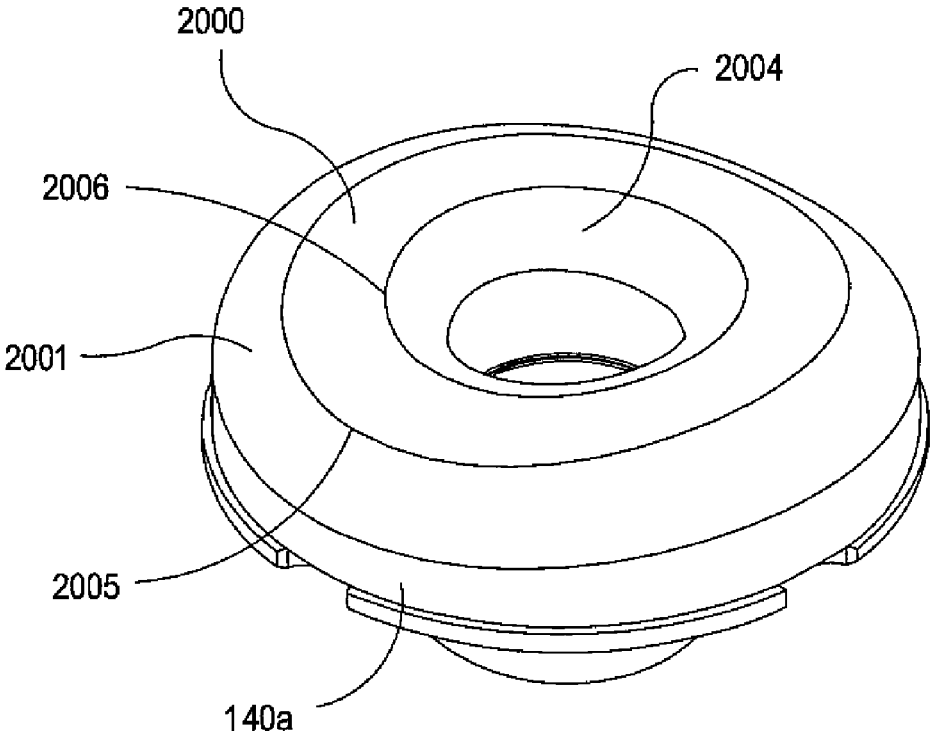

To further understand the commutational switching in the brushless DC motor, reference is now made to FIGS. 16A and 16B, which show a state table and theoretical timing diagram indicating the commutational switching of the various windings in a brushless, three-phase DC motor. The difference between the two figures is that FIG. 16A represents a rotor traveling in a first direction and FIG. 16B represents rotor motion in a second, opposite direction. In the preferred embodiment, only the first direction is utilized as shown in state table 16A. In accordance with the preferred embodiment, a commutational switching event occurs every 60° in a 360° period. Consequently, rotor position can be categorized into one of six possible states T1-T6.

The state tables shown in FIGS. 16A and 16B include the winding voltage level and switch control logic signals N_High and N_Low for each phase and for each individual state T1:T6. For example, in state table 650 corresponding to a forward rotor direction, state T3 indicates that winding 1 (W1) should be pulled low or grounded and Winding 2 (W2) should be pulled high to the excitation voltage. By default, since W1 is low and W2 is high, W3 should be off.

The corresponding timing diagram 655 shows a qualitative representation of the winding voltage levels W1-W3 during each state T1-T6. The horizontal lines in the timing diagrams represent a reference threshold Vref for each winding. Thus, in state T3 of timing diagram 655, W1 is shown below Vref (Low), W1 is shown above Vref (High), and W3 is shown rising from a low state to a high state (Float). Similarly, state table 660 and timing diagram 665 are equivalent representations for the opposite rotor direction. The PLD 525 preferably interprets the Demod_N signals for each phase to determine the current rotor state and switches to the subsequent state when the appropriate threshold crossings occur in the Sync_N, Hall_N, and Inv_Hall_N signals appear.

Turning to additional operating abilities of the formation test tool, certain adverse borehole size and borehole conditions can be overcome by operating the formation test tool in certain orientations. For example, if the borehole 8 (FIG. 1) is oversized for some reason, when the probe assembly 50 is extended for a formation test, the pad 140 may extend to it's full limit without making any contact with the borehole wall 151, or it may extend and make contact without making sufficient engagement with the borehole wall 151 to seal. Reasons for borehole 8 being oversized include hole washout, and holes drilled with bi-centered bits. When bi-centered bits are used, the stabilizer 154 (FIG. 2D) must preferably be sized approximately ¼ inch diameter smaller than the pilot diameter of the bi-centered bit. Common examples of bi-centered bit sizes are: 8½ inch pilot diameter for 9⅞ inch hole size; and 10 ⅝ inch pilot diameter for 12¼ inch hole size.

In situations where borehole 8 is oversized, it is preferable to orient the probe 50 towards the low side of the borehole. If sufficient inclination of the borehole 8 exists at the desired depth of the formation test, the weight of the bottom hole assembly 6 (FIG. 1) may react enough force of pad 140 against the borehole wall 151 to cause the pad 140 to sufficiently seal against the borehole wall 151 to make a formation pressure test. The preferred minimum inclination is 40 degrees. It may be possible for the weight of the bottom hole assembly 6 to react enough force to generate a seal of pad 140 against the borehole wall 151 at lower inclinations as well. Orienting the probe 50 towards the low side of the borehole 8 may not be desirable in conditions where excessive debris has settled to the low side of the borehole 8. This condition can occur when there is sufficient inclination of the borehole 8 to collect debris on the low side of the borehole 8 as the debris settles out of the drilling fluid in annulus 150 of borehole 8 (FIG. 1). Poor hole cleaning practices, poor drilling fluid properties, and long sections of highly deviated borehole can all contribute to this adverse condition. To overcome this condition, it is possible to orient the probe 50 toward the high side of the borehole 8. If borehole 8 is not excessively oversized, probe 50 will extend such that pad 140 will make sufficient engagement with borehole wall 151 to seal and make a formation pressure test.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus comprising:

a drill collar having an outer surface;

an assembly for interaction with an earth formation coupled to the drill collar, said assembly comprising:

a first member to extend beyond said drill collar outer surface; and a second member to extend beyond said first member and toward the earth formation to receive formation fluids.

2. The apparatus of claim 1 wherein said second member couples to the earth formation.

3. The apparatus of claim 1 wherein said assembly is recessed beneath said drill collar outer surface in a first position.

4. The apparatus of claim 1 further comprising an elastomeric seal pad coupled to said first member to engage the earth formation.

5. The apparatus of claim 4 wherein said first member has a first passageway and said seal pad has an outer surface and an aperture, said second member to extend though said first passageway and said aperture to a position beyond said seal pad outer surface.

6. The apparatus of claim 5 wherein said seal pad deforms against said first member to prevent said seal pad from entering said first passageway and to provide a seal.

7. The apparatus of claim 1 wherein said first member is a piston and said second member is an inner snorkel.

8. The apparatus of claim 1 wherein said first member is coupled to said second member.

9. The apparatus of claim 1 wherein said first member houses said second member and carries said second member beyond said drill collar outer surface, and then said second member extends from said first member to a position beyond said first member.

10. The apparatus of claim 1 wherein said assembly includes a single fluid path to receive formation fluids.

11. An apparatus comprising:

an MWD tool having an outer surface;

a formation testing assembly coupled to said MWD tool, said formation testing assembly recessed beneath said outer surface in a first position and including:

a piston to extend beyond said outer surface to a second position; and an inner sampling member to extend from and beyond said piston to a third position to receive formation fluids.

12. The apparatus of claim 11 wherein said inner sampling member couples to an earth formation.

13. The apparatus of claim 11 further comprising a seal pad coupled to said piston, said seal pad having an outer surface and said inner sampling member third position being beyond said seal pad outer surface.

14. The apparatus of claim 13 wherein said seal pad is elastomeric and further includes an aperture, said inner sampling member to extend though said aperture and prevent deformation of said seal pad at said aperture and provide a seal.

15. A system for drilling a borehole and testing an earth formation comprising:

a drill string having a drill bit and a bottom hole assembly;

an MWD tool coupled to said bottom hole assembly;

a formation testing assembly coupled to said MWD tool comprising:

a first member having a seal pad with an outer surface, said first member to extend said seal pad into engagement with an earth formation; and a second member to extend from said first member and beyond said seal pad outer surface to receive formation fluids.

16. A method of engaging an earth formation for testing comprising:

disposing a formation testing assembly on a drill string, said formation testing assembly having a first extendable member and a second extendable member;

drilling a bore hole in an earth formation;

extending said first extendable member beyond an outer surface of the drill string;

further extending said second extendable member from said first extendable member to a position beyond said first extendable member; and receiving fluids from the earth formation through said second extendable member.

17. The method of claim 16 further comprising:

disposing a seal pad having an outer surface and an aperture on said first extendable member; and engaging the earth formation with said seal pad to provide a first seal between said formation testing assembly and the earth formation.

18. The method of claim 17 further comprising:

extending said second extendable member through said seal pad aperture and beyond said seal pad outer surface; and deforming said seal pad against said second extendable member to provide a second seal.

19. The method of claim 16 further comprising coupling said second extendable member to the earth formation.

20. The method of claim 16 wherein said first extendable member is coupled to said second extendable member.

* * * * *